US008439464B2

(12) United States Patent
Kano et al.

(10) Patent No.: US 8,439,464 B2
(45) Date of Patent: May 14, 2013

(54) INKJET PRINTING APPARATUS AND INKJET PRINTING METHOD

(75) Inventors: Yutaka Kano, Yokohama (JP); Hiroshi Tajika, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 873 days.

(21) Appl. No.: 12/118,967

(22) Filed: May 12, 2008

(65) Prior Publication Data

US 2008/0284808 A1 Nov. 20, 2008

(30) Foreign Application Priority Data

May 15, 2007 (JP) ..... 2007-129356

(51) Int. Cl.
*B41J 29/38* (2006.01)

(52) U.S. Cl.
USPC ..... 347/12

(58) Field of Classification Search ..... 347/12
See application file for complete search history.

(56) References Cited

U.S. PATENT DOCUMENTS 6,155,668 A * 12/2000 Otsuki et al. ..... 347/41
6,764,154 B2 7/2004 Nishikori et al. ..... 347/12
7,284,823 B2 10/2007 Nishikori et al. ..... 347/70
2005/0179758 A1 8/2005 Campillo et al. ..... 347/101
2008/0074455 A1* 3/2008 Yoshida et al. ..... 347/15

FOREIGN PATENT DOCUMENTS

JP 11245388 9/1999
JP 11-291506 A 10/1999
JP 2002-225243 8/2002
JP 2005-231353 A 9/2005
JP 2006-096031 A 4/2006

* cited by examiner

*Primary Examiner* — Uyen Chau N Le
*Assistant Examiner* — Hoang Tran
(74) *Attorney, Agent, or Firm* — Fitzpatrick, Cella, Harper & Scinto

(57) ABSTRACT

Provided is an inkjet printing apparatus for performing a printing with a first nozzle array for ejecting a first color ink and a second nozzle array for ejecting a second color ink. The apparatus reduces density unevenness stemming from a sudden error in conveyance of a printing medium. When the apparatus performs a scan with respect to the printing medium for printing in which using ranges of nozzles in the first and second nozzle arrays are restricted to parts thereof, the restricted using ranges of the first and second nozzle arrays are shifted from each other. Thereby, the density unevenness stemming from the error in conveyance occur in positions which are different between the first and second colors, Thus, it possible to make the overall density unevenness less obvious by making gradients of variations in brightness and chroma of an image smaller.

9 Claims, 24 Drawing Sheets

INKJET PRINTING APPARATUS AND INKJET PRINTING METHOD

BACKGROUND OF THE INVENTION

1. Field of the Invention

The present invention relates to an inkjet printing apparatus and an inkjet printing method. Specifically, the present invention relates to a technique for suppressing an image defect attributed to an error in conveyance of a printing medium.

2. Description of the Related Art

A general configuration of an inkjet printing apparatus includes a conveying unit for conveying a printing medium along a predetermined conveying path, and a printing head in which nozzles are arranged for ejecting the inks on the printing medium thus conveyed. The inkjet printing apparatus performs a printing by an alternate series of an operation for ejecting the inks from the nozzle while causing the printing head to move in the main scanning direction different from a direction in which the nozzles are arranged and an operation for causing the conveying unit to convey the printing medium in a sub-scanning direction orthogonal to the main scanning direction.

In this respect, there is a printing apparatus of a type which has two conveying units (hereinafter referred to as an upstream conveying unit and a downstream conveying unit) respectively arranged upstream and downstream of a position (a printing position) where the printing apparatus performs a printing by use of the printing head. The upstream conveying unit and the downstream conveying unit are involved in a printing medium conveyance operation including supplying a printing medium to the printing position and discharging the printing medium from the printing position. In general, the upstream conveying unit includes a conveying roller, whereas the downstream conveying unit includes a discharge roller. A set of pinch rollers is provided to the conveying roller to hold a printing medium between the conveying roller and the pinch rollers while elastically biased by a pressing member such as a spring, whereas a set of spur rollers is provided to the discharge roller to hold the printing medium between the discharge roller and the spur rollers while elastically biased by a pressing member such as a spring. Specifically, the upstream conveying unit and the downstream conveying unit are respectively configured of a roller pair of the conveying roller and the set of pinch rollers, and a roller pair of the discharge roller and the set of spur rollers.

While the inkjet printing apparatus of this type is making a printing in the front end portion of the printing medium, the printing medium is conveyed by the upstream conveying unit only. Further, while the inkjet printing apparatus of this type is making a printing in the rear end portion of the printing medium, the printing medium is conveyed by the downstream conveying unit only. For this reason, the inkjet printing apparatus of this type tends to convey the printing medium with a lower accuracy. This kind of conveying condition takes place when the inkjet printing apparatus is making a printing (termed as a margin-less printing) on the front or rear end portion of the printing medium with no margin left there, or a printing near the front or rear end of the printing medium even with a margin left there. If the printing medium is conveyed at an insufficiently short distance between two consecutive main scans, an image formed during the main scan overlaps another image formed during the subsequent main scan on the printing medium, so that what is termed as a black stripe occurs. By contrast, if the printing medium is conveyed at an excessive distance between two consecutive main scans, an image formed during the first main scan is distanced from another image formed during the subsequent main on the printing medium scan, so that what is termed as a white stripe occurs.

In addition to these types of image defects stemming from the reduced accuracy with which a printing medium is conveyed, another type of image defect stems from a printing medium which is not held by both the upstream conveying unit and the downstream conveying unit. While a printing medium is being held by either of the two conveying units, the distance between the printing head and the printing medium (hereinafter referred to as a "medium-to-head distance") varies to a non-negligible extent because the printing medium curls. As a result, the printing medium is likely to be placed in an unstable condition. The printing head is designed to perform printing scans while ejecting inks on the printing medium at timings corresponding to a predetermined medium-to-head distance maintained by both the upstream and downstream conveying units. Thus, inks ejected at appropriate timings form dots, and these dots are arranged in appropriate pitches on the printing medium to form an image. For this reason, if the medium-to-head distance varies while a printing is being performed, or if the medium-to-head distance varies to a large extent in a printing swath, dots are positioned on the printing medium unstably. This causes image defects, including a white stripe, a black stripe and a granular impression.

In this respect, a scheme of reducing a conveying distance of a printing medium at one time is effective for increasing the conveyance accuracy of printing medium. However, a uniform reduction of the one-time conveying distance throughout the printing medium reduces printing throughput. To avoid a reduction in the throughput, a one-time conveyance distance for the front and rear end portions of a printing medium is usually set shorter than a one-time conveyance distance for a central portion of the printing medium. This is because the front and rear end portions thereof are conveyed with the specifically reduced accuracy, and because the central portion thereof is held by both the upstream and downstream conveying units. If, however, the front and rear end portions thereof are conveyed at a shorter distance at one time than the central portion thereof while a range of nozzles within a nozzle arrangement range of the printing head is used to perform the printing without any change, the density becomes uneven because there is a difference in the number of printing scans in a unit of printing area between the front and rear end portions of the printing medium, and the central portion thereof.

With this taken into consideration, particularly a serial type of printing apparatus, emphasizing its image quality, takes the following step against an image defect which would otherwise occur while making a printing in the front and rear end portions of a printing medium. For example, Japanese Patent Laid-Open No. 2004-98668 describes a method using a printing head in which the nozzles are arranged with a density corresponding to a printing density in the same direction as a printing medium is conveyed. In this method, a printing is performed on the front and rear end portions of a printing medium by using only a restricted part of the nozzles as a using range of nozzles (nozzle-use range) while the printing medium is conveyed at shorter distance at one time. Even when a conveyance accuracy of the printing medium decreases, the foregoing method is capable of reducing the conveyance error of the printing medium by decreasing the distance at which the printing medium is conveyed at one time. In addition, the method decreases the printing swath for each main scan, and is thus capable of suppressing the adverse affect of the variation in the medium-to-head distance. Furthermore, the method narrows down the pitch of image forming areas connected to each other and printed by the two consecutive main scans a connecting portion between image forming areas respectively corresponding to each two consecutive main scans. As a result of all of the foregoing effects, the method brings about an effect of making white and black stripes unobvious.

A combined use of the foregoing method and what is termed as a multi-pass printing method is more effective against an image defect which would otherwise occur when a printing is performed in the front and rear end portions of a printing medium. In addition, an effect against the granular impression is also expected of the combined use. The multi-pass printing method is for forming an image on a printing medium by making a printing in each printing area on the printing medium by multiple main scans while conveying the printing medium at a distance shorter than the printing swath between two consecutive main scans. In the case of the multi-pass printing method, for each main scan, it is predetermined which nozzles are used to eject inks and which nozzles are not, that is, which dots are allowed to be printed and which are not. To put it the other way, a print allowing rate is predetermined for each main scan. Furthermore, mask patterns are applied in order that multiple main scans should be mutually complementary to perform a printing. In this respect, Japanese Patent Laid-Open No. 2005-231353 describes a technique for changing mask patterns to be applied to the nozzle-use range to perform a printing on the rear end portion of the printing medium when the printing proceeds from the central portion to the rear end portion. In addition, a proposal has been made that an image defect should be reduced by using mask patterns, whose print allowing rates have a larger gradient for the nozzle-use range used for the front and rear end portions of a printing medium than that for the nozzle-use range used for the central portion thereof (Japanese Patent Laid-Open No. 2006-96031).

On the other hand, there are apparatuses of a type using a method of making a printing on a printing medium by use of a printing head in which the nozzles are arranged in a density lower than the printing density while interpolating the printing density in the sub-scanning direction with multiple main scans. To carry out this interpolation, the printing medium is conveyed between each two consecutive main scans so that the nozzles can be positioned in a line having no dots formed by the previous main scan. This method is termed as an interlace printing method. Among apparatuses using this method, some further employs the method for making a printing in the front and rear end portions of the printing medium with a smaller nozzle range while conveying the printing medium at a shorter distance between each two consecutive main scans (for example, Japanese Patent Laid-Open No. 11-291506 (1999)).

Application of these techniques reduces an image defect which would otherwise occur when a printing is performed in the front end portion of the printing medium held and conveyed only by the upstream conveying unit, and when a printing is performed in the rear end portion of the printing medium held and conveyed only by the downstream conveying unit.

However, the inventors of the present invention have found that a mere application of the techniques disclosed in the foregoing documents rather performs the printing density uneven in some cases. Descriptions will be provided hereinbelow for this finding.

In some cases, an error in conveyance of a printing medium suddenly takes place due to an impact which occurs when the front end of the printing medium goes into the downstream conveying unit (or plunges into a nipping part between the discharge roller and the spur rollers). In addition, in some cases, another error in conveyance of the printing medium suddenly takes place due to an impact which occurs when the rear end of the printing medium comes out of the upstream conveying unit (or is released from the nipping part between the conveying roller and the pinch rollers).

Here, let us assume that a first nozzle array for ejecting an ink of a first color and a second nozzle array for ejecting an ink of a second color whose tone is different from that of the first color are used. Under this condition, if the techniques disclosed in the foregoing documents are merely applied, the nozzle-use ranges are restricted to certain parts in the first and second nozzle arrays at the same positions relative to the whole nozzle arrays. For this reason, a sudden conveyance error uniformly displaces an image forming area printed with the first nozzle array and an image forming area printed with the second nozzle array, from their ideal positions. This brings about a problem that the sudden conveyance error varies density or brightness obviously.

SUMMARY OF THE INVENTION

An object of the present invention is to reduce density unevenness which takes place due to a sudden error in conveyance of a printing medium in a configuration of conveying the printing medium at a decreased distance while the printing medium is being held by only either an upstream conveying unit or a downstream conveying unit. Particularly, the present invention is preferably applied to an inkjet printing apparatus and an inkjet printing method of making a printing by use of multiple inks which are different in color tone from one another.

In a first aspect of the present invention, there is provided an inkjet printing apparatus for performing printing on a printing medium by using a printing head having a first nozzle array on which nozzles for ejecting ink of a first color are arranged and a second nozzle array on which nozzles for ejecting ink of a second color different from the first color are arranged, the apparatus comprising:

a scanning unit that performs scans of the printing head with respect to the printing medium;

a conveying unit that conveys the printing medium in a direction crossing a direction of the scans of the printing head; and a print controller capable of selectively executing, depending on a conveying position of the printing medium, either a scan for performing a printing in which a using range of nozzles is set equivalently between the first and second nozzle arrays, or a scan for performing a printing in which using ranges of nozzles in the first and second nozzle arrays are restricted to parts thereof, as well as the restricted using range of nozzles is set differently between the first and second nozzle arrays.

In a second aspect of the present invention, there is provided an inkjet printing apparatus for performing printing on a printing medium by using a printing head having a first nozzle array on which nozzles for ejecting ink of a first color are arranged and a second nozzle array on which nozzles for ejecting ink of a second color different from the first color are arranged, the apparatus comprising:

a scanning unit that performing scans of the printing head with respect to the printing medium;

a conveying unit that conveys the printing medium in a direction crossing a direction of the scans of the printing head; and a print controller capable of selectively executing, depending on a conveying position of the printing medium, either a scan for performing a printing in which a using range of nozzles in the conveying direction is set equivalently between the first and second nozzle arrays, or a scan for performing a printing in which a using range of nozzles in the conveying direction is set differently between the first and second nozzle arrays.

In a third aspect of the present invention, there is provided an inkjet printing apparatus for printing on a printing medium by using a printing head having a first nozzle array on which nozzles for ejecting ink of a first color are arranged and a second nozzle array on which nozzles for ejecting ink of a second color different from the first color are arranged, the apparatus comprising:

a print controller that performs printing while restricting using ranges of nozzles in the first and second nozzle arrays to the parts thereof in a plurality of scans of the printing head to a unit area on the printing medium, wherein the print controller makes the distribution in a print allowing rate which is set for each of the plurality of scans different between the restricted using ranges of nozzles in the first nozzle array and the second nozzle array.

In a fourth aspect of the present invention, there is provided an inkjet printing method of printing on a printing medium by using a printing head having a first nozzle array on which nozzles for ejecting ink of a first color are arranged and a second nozzle array on which nozzles for ejecting ink of a second color different from the first color are arranged, the method comprising the steps of:

printing by using the printing head in a scan of the printing head with respect to the printing medium;

conveying the printing medium in a direction crossing a direction of the scan of the printing head; and switching, depending on a conveying position of the printing medium, a printing in which a using range of nozzles is set equivalently between the first and second nozzle arrays, and a printing in which a using range of nozzles is set differently between the first and second nozzle arrays.

The present invention makes it possible to make density unevenness stemming from a conveyance error less obvious by making gradients of variations in brightness and chroma of an image smaller while causing the density unevenness in positions which are different from one color to another.

Further features of the present invention will become apparent from the following description of exemplary embodiments (with reference to the attached drawings).

DESCRIPTION OF THE EMBODIMENTS

Detailed descriptions will be provided hereinbelow for the present invention by referring the drawings.

(First Embodiment)

Figure 1:
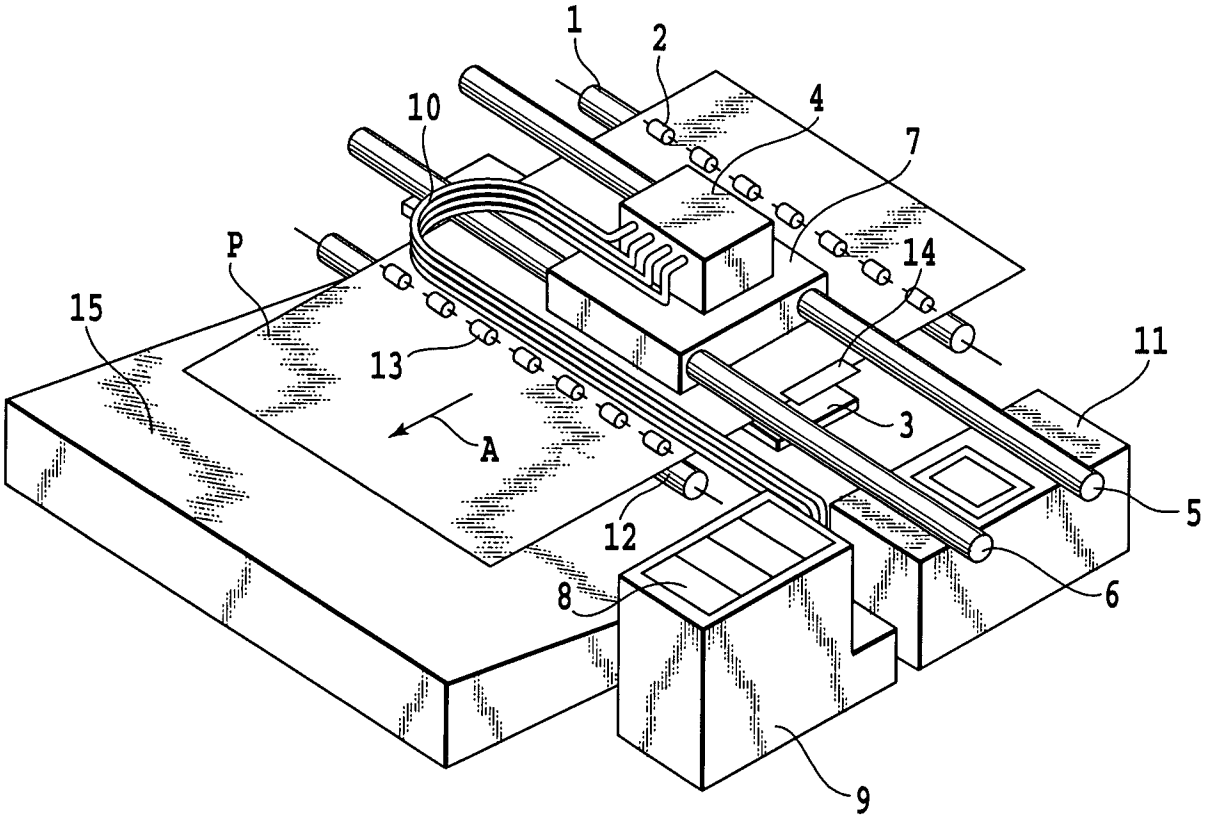
FIG. 1 is a perspective view showing an overall configuration of an inkjet printing apparatus according to a first embodiment of the present invention.

FIG. 1 is a perspective view showing an overall configuration of an inkjet printing apparatus according to one of the embodiment of the present invention. While a printing is performed, a printing medium P is held between a conveying roller 1 arranged on a conveying path and pinch rollers 2 driven by the conveying roller 1, and is conveyed in a direction indicated by an arrow A in FIG. 1 while guided onto and supported by a platen 3 in response to the rotation of the conveying roller 1. The pinch rollers 2 are elastically biased toward the conveying roller 1 by a pressing member such as a spring, which is not illustrated in FIG. 1. The conveying roller 1 and the pinch rollers 2 are components constituting a first conveying unit located upstream in a direction in which the printing medium is conveyed.

The platen 3 is placed in a printing position which is opposed to a face (or an ejection face) of an inkjet-head typed printing head 4 where ejection openings are formed. The platen 3 supports the back surface of the printing medium P. This support keeps the distance between the top surface of the printing medium P and the ejection face constant and equal to a predetermined distance.

The printing medium P on which a printing is performed with conveying onto the platen 3 is subsequently conveyed in the A direction while held between a rotary discharge roller 12 and spur rollers 13 which are rotary bodies driven by the discharge roller 12, and is thereafter discharged from the top of the platen 3 onto a discharge tray 15. The discharge roller 12 and the spur rollers 13 are components constituting a second conveying unit located downstream in the direction in which the printing medium is conveyed.

A printing medium holder 14 is placed above the platen 3 for the purpose of restricting the side ends of the printing medium P in a direction crossing over the conveyance direction A from curling upwards or toward the ejection face of the printing head 4. The printing head 4 is detachably mounted on a carriage 7 with its ejection face being opposed to the platen 3 and the printing medium P. The carriage 7 is reciprocated along two guide rails 5 and 6 by a driving unit such as a motor, which is not illustrated in FIG. 1. While reciprocated, the printing head 4 can eject inks. The directions in which the carriage 7 is reciprocated crossing the direction in which the printing medium is conveyed (or in the direction indicated by the arrow A), and is termed as a main-scanning direction. By contrast, the direction in which the printing medium is conveyed is termed as a sub-scanning direction. A printing is performed on the printing medium P by an alternate series of the main scan of the carriage 7 and the printing head 4 as well as the conveyance (or the sub-scan) of the printing medium.

The printing head 4 may be that which includes an element (for example, a heat-generating resistor element) for generating a thermal energy as an energy used for the ink ejection, and which uses a method of changing the state (or causing a film boiling) of the inks by use of the thermal energy. Otherwise, the printing head 4 may be that which includes an element such as a piezoelectric element for generating a mechanical energy as the energy-generating element, and which ejects the inks by use of the mechanical energy.

With regard to the configuration of the printing head, the printing head may be that in which a plurality of nozzle arrays are arranged in a way that the plurality of nozzle arrays respectively correspond to mutually different ink colors, and in a way that each nozzle array includes nozzles which are arranged with a density corresponding to a printing density in the direction in which the printing medium is conveyed.

Figure 2:
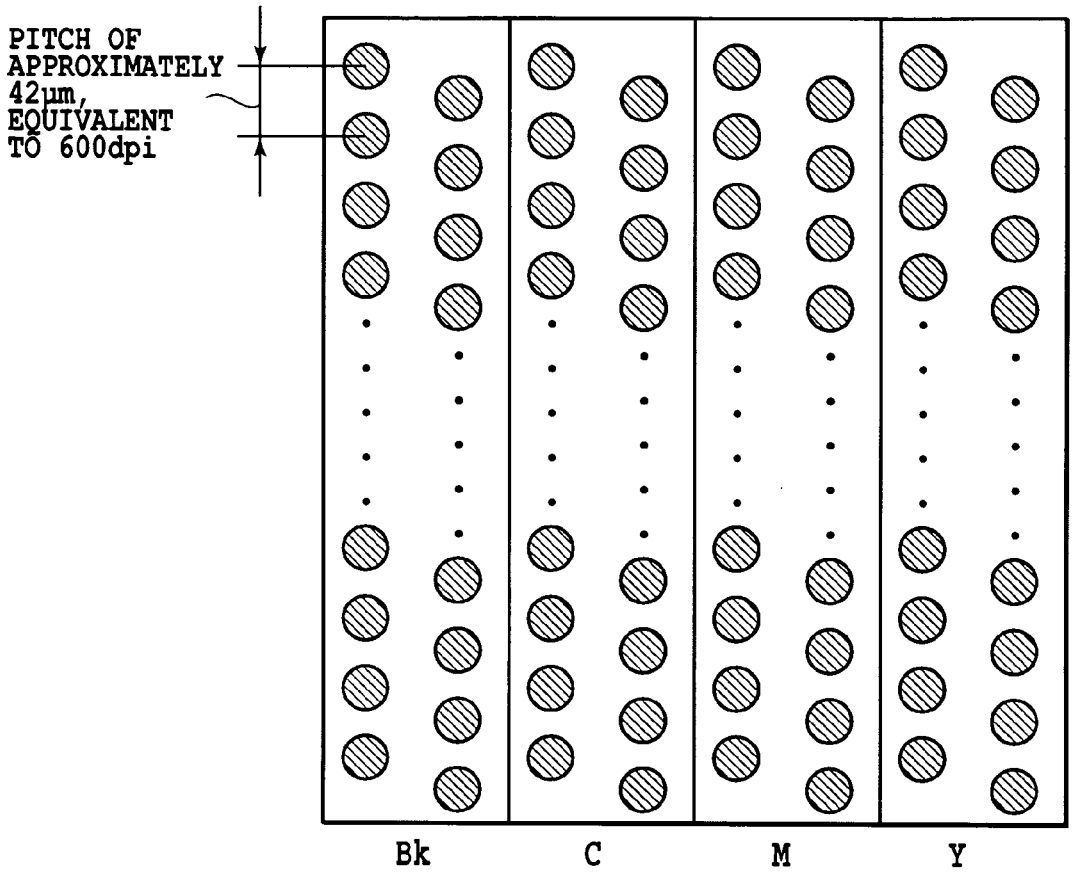
FIG. 2 is a schematic front view of a printing head used in the apparatus shown in FIG. 1.

FIG. 2 is a schematic front view of such a printing head. FIG. 2 shows an example of the printing head of a type including two nozzle columns for each color. The two nozzle columns are assigned to each color, and are staggered by approximately 21 μm in the sub-scanning direction (or in the conveying direction). Each nozzle column has 384 nozzles which are arranged one after another at pitches of 600 dpi (dot per inch), i.e., at pitches of approximately 42 μm. As a result, the two nozzle columns constitute a nozzle array for each color and a 1200-dpi resolution is realized with a total of 768 nozzles for each color. The illustrated example of the printing head has a head configuration in which a total of 8 nozzle columns (4 nozzle arrays) are arranged side-by-side in the main-scanning direction in a way that each pair of nozzle arrays corresponds to each of four colors such as black (Bk), cyan (C), magenta (M) and yellow (Y), as well as which accordingly performs a 1200-dpi printing by use of the total of 8 nozzle arrays.

Such a printing head is capable of carrying out a printing method of completing a printing on each unit area on the printing medium with one main-scan. This printing method is termed as a 1-pass printing method. Instead, such a printing head is capable of carrying out a printing method of completing a printing on each unit area on the printing medium with multiple main scans for the purpose of enhancing the printing quality by reducing an adverse affect of variation of nozzles on the printing quality. This printing method is termed as a multi-pass printing method. How many times the printing head should scan for a multi-pass printing operation is determined depending on a printing mode adopted for the printing operation and other conditions whenever deemed necessary.

Figure 3:
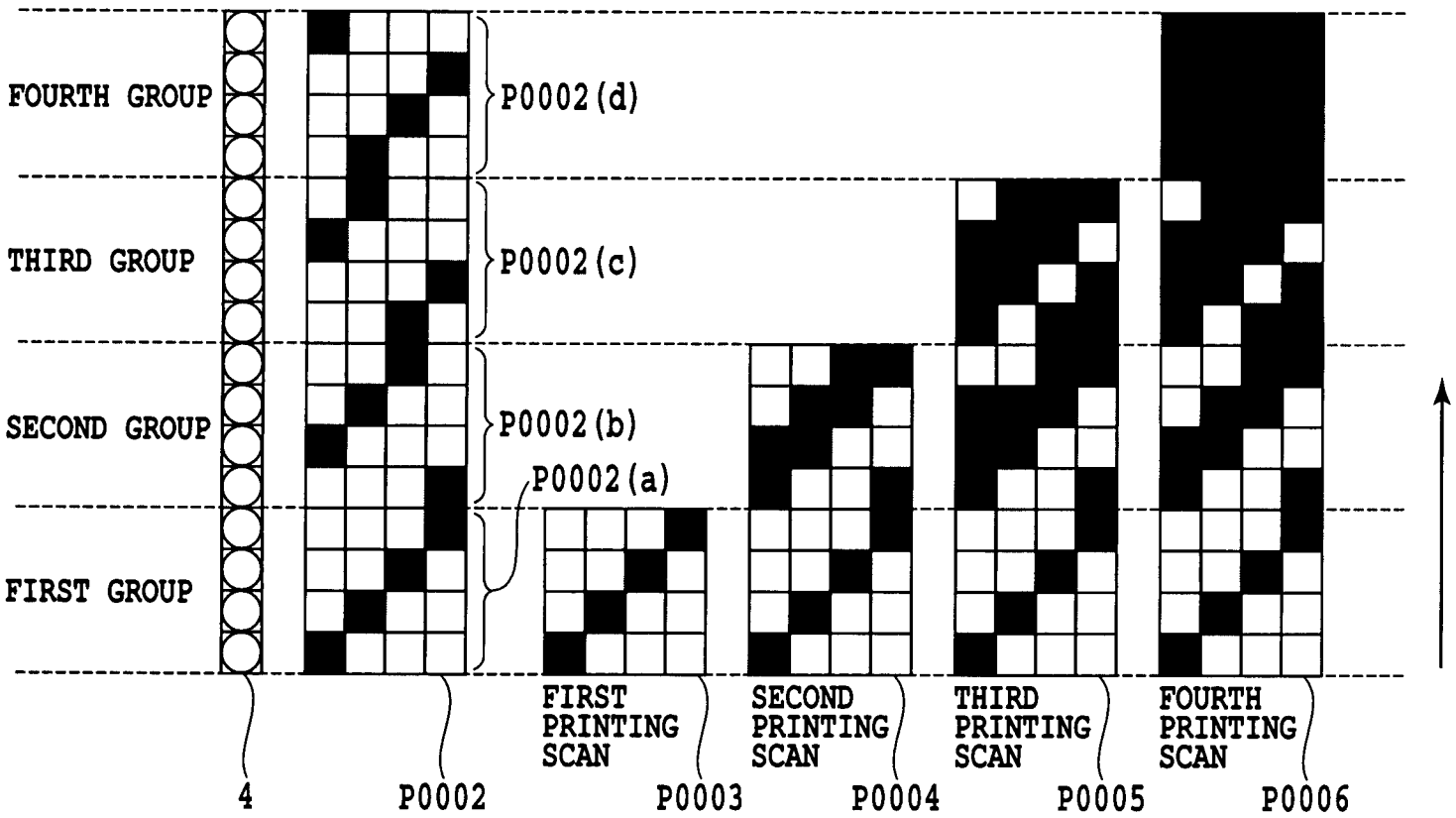
FIG. 3 is an explanatory diagram which schematically shows the printing head and printing patterns for the purpose of explaining a multi-pass printing method adoptable for the printing apparatus.

FIG. 3 schematically shows the printing head and printing patterns for the purpose of explaining a multi-pass printing method adoptable for the printing apparatus. FIG. 3 shows examples respectively of the printing head and the printing patterns which are adopted in a case where a printing is completed with four main scans (in a case of a 4-pass printing method). Descriptions will be provided with an assumption that the printing head 4 has 16 nozzles for each of the four colors for the purpose of making the descriptions simpler. In other words, it is assumed that, as shown in FIG. 3, the nozzles corresponding to each color are divided into four nozzle groups such as a first to fourth nozzle group so that each nozzle group for each color includes four nozzles. A mask P0002 includes a first to fourth mask patterns P0002 (*a*) to P0002 (*d*). The first to fourth mask patterns P0002 (*a*) to P0002 (*d*) define areas which the first to fourth nozzle groups are capable of making a printing. Each black area in the mask pattern indicates an area (a print-allowed area) in which an ink is allowed to be ejected depending on data on the printing. Each white area in the mask pattern indicates an area (a non-printing area) in which no ink is allowed to be ejected regardless of the data on the printing. The first to fourth mask patterns P0002 (*a*) to P0002 (*d*) defines how pixels complementary to one another are arranged in a unit image area. The overlapping of the four mask patterns completes a printing in the image area corresponding to the 4×4 areas.

Patterns P0003 to P0006 show how an image is completed through repeated printing scans. Each time a printing scan is completed, the printing medium is conveyed at a distance equal to the width of each nozzle group (or at a distance equal to four nozzles arranged in a line in the example shown in FIG. 3) in the arrowed direction. As a result, in each image area (or in each area corresponding to the width of each nozzle group), an image is completed by a set of four printing scans. The formation of an image in each image area with the multiple scans by use of the multiple nozzle groups in the above-described manner is effective for reducing intrinsic variation from one nozzle to another, variation in conveyance precision, and the like.

Note that the printing head may be configured of the nozzles arranged at lower density than the printing density. In addition, the interlace printing method may be adopted to perform a printing by multiple main scans while interpolating the recoding density in the sub-scanning direction. To carry out this interpolation, a printing medium is conveyed between each two consecutive main scans in a way that the nozzles can be positioned in lines having no dots formed by the previous main scans. In other words, even when the nozzles are arranged in a density corresponding to a low resolution, the high-resolution printing may be performed by printing each unit image area multiple times in an overlapping manner with the nozzles in the nozzle-use range while conveying the printing medium between each two consecutive printing scans at a distance equal to the length of a predetermined number of pixels that is not longer than the width of each nozzle array.

Figure 4:
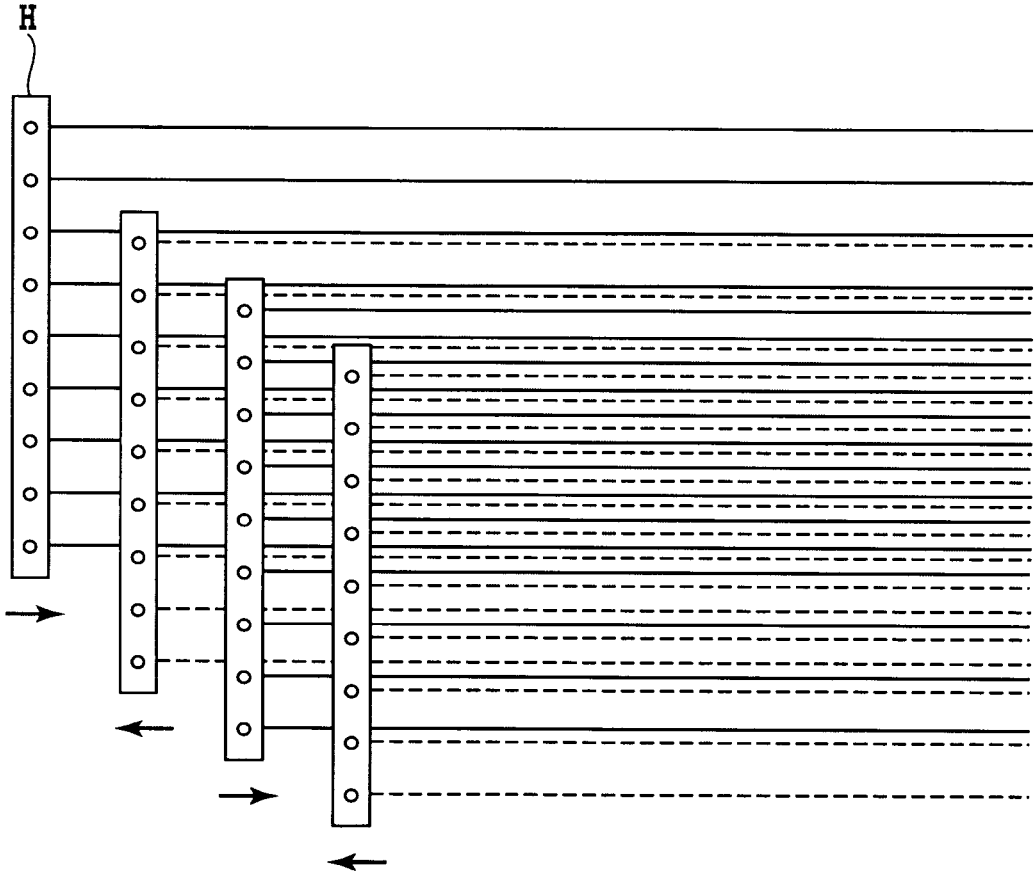
FIG. 4 is an explanatory diagram used for explaining an interlace printing method adoptable for the printing apparatus.

Brief descriptions will be provided for the interlace printing method by use of FIG. 4. In this respect, let us assume that a 1200-dpi image is intended to be completed by a head H in which the nozzles are arranged at pitches of 300 dpi. For the purpose of making descriptions simpler, it is assumed that the number of nozzles is 9, and that the distance at which a printing medium is conveyed in an interval between each two consecutive printing scans is equal to the length of 9 pixels arranged in a line in 1200 dpi. A raster in which a printing is performed while moving the head H forwardly is indicated by a solid line, and the other raster in which a printing is performed while moving the head H backwardly is indicated by a broken line. The two rasters are formed in alternations.

Referring FIG. 1 again, a plurality of independent ink tanks 8 are detachably mounted on a tank mounting unit 9. The ink tanks 8 correspond to colors of inks ejected from the printing head 4, respectively. The tank mounting unit 9 is connected to the printing head 4 with a plurality of liquid supplying tubes 10 corresponding to the respective ink colors. The mounting of the ink tanks 8 on the tank mounting unit 9 enables color inks contained in the respective ink tanks 8 to be independently supplied to their corresponding nozzle arrays in the printing head 4. It goes without saying that the ink tanks corresponding to the respective color inks may be designed to be detachably mounted directly on the printing head 4.

A recovery unit 11 is arranged opposable to the ejection face of the printing head 4 in a non-printing area which is an area outward of the printing medium P and the platen 3, and which area is within the movable range of the printing head 4 in the main-scanning direction. The recovery unit 11 has a known configuration as follows. The configuration includes: a cap section for capping the ejection face of the printing head 4; a suction mechanism for forcibly suctioning inks from the printing head 4 with the ejection face being capped; a cleaning blade for wiping off blots on the ink ejection face; and the like.

Figure 5:
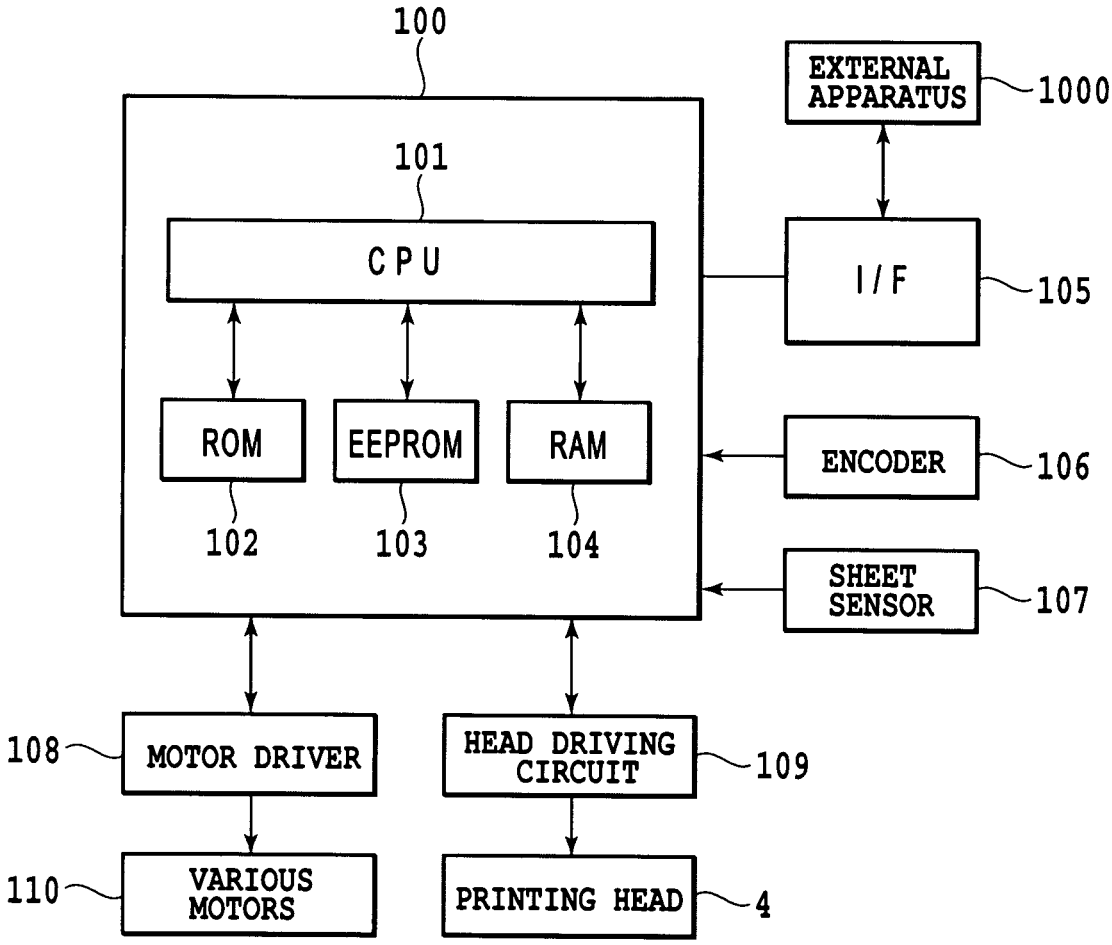
FIG. 5 is a block diagram showing an example of a configuration of a principal part of a control system in the apparatus shown in FIG. 1.

FIG. 5 shows an example of a configuration of a principal part of a control system in the inkjet printing apparatus according to this embodiment. In FIG. 5, reference numeral 100 denotes a control unit for controlling all of the driving units in the inkjet printing apparatus according to this embodiment. The control unit 100 includes a CPU 101, a ROM 102, an EEPROM 103, a RAM 104. The CPU 101 carries out various types of arithmetic process, and makes various judgments, for the purpose of performing a printing operation including the below-described procedures, as well as processes printing data. The ROM 102 is for storing programs corresponding to the procedures carried out by the CPU 101, other fixed data and the like. The EEPROM 103 is a non-volatile memory, and is used for retaining predetermined information while the power supply to the printing apparatus is OFF. The RAM 104 is that in which the printing data which is supplied from the outside and printing data which is a result of expanding the supplied printing data in accordance with the apparatus configuration are temporarily stored, and functions as a work area for an arithmetic process carried by the CPU 101.

An interface (I/F) 105 has a function of connecting itself to an external apparatus 1000, and performs two-way communications between itself and the external apparatus on a basis of a predetermined protocol. It should be noted that the external apparatus 1000 had a known configuration such as a computer, and that the external apparatus 1000 works as a supply source of the printing data for printing by the printing apparatus according to the present embodiment. In the external apparatus 1000, a printer driver as a program for making the printing apparatus carry out the printing operation is installed. Specifically, the printing data, information on a print set-up which includes information on a type of a printing medium on which the printing data is printed, and control command for controlling the operation of the printing apparatus are sent from the printer driver.

An encoder 106 detects a position of the printing head 4 in the main-scanning direction. The sheet sensor 107 is placed in an appropriate position in the conveyance path along which the printing medium is conveyed. It is possible to recognize a position at which the printing medium is being conveyed (sub-scanned) by detecting the front and rear ends of the printing medium by use of this sheet sensor 107. A motor driver 108 and a head driver circuit 109 are further connected to the control unit 100. Under the control of the control unit 100, the motor driver 108 drives a conveying motor working as a driving source of conveyance of the printing medium, a main-scanning motor working as a driving source of causing the carriage 7 to reciprocate, and the other various motors. Under the control of the control unit 100, the head driver circuit 109 drives the printing head 4, and causes the printing head 4 to carry out an ejection operation.

Descriptions will be provided next for a manner that a printing medium is conveyed by the printing apparatus according to the present embodiment.

Figure 6:
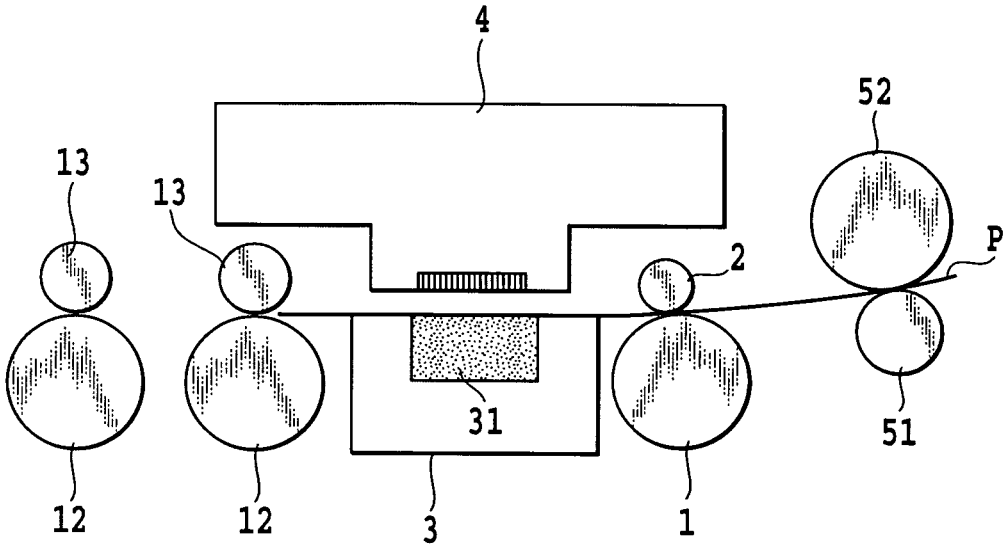
FIG. 6 is a side view schematically showing the printing head, a printing medium, and a conveying mechanism for conveying the printing medium, which take part in making a printing in a front end portion of the printing medium.
Figure 7:
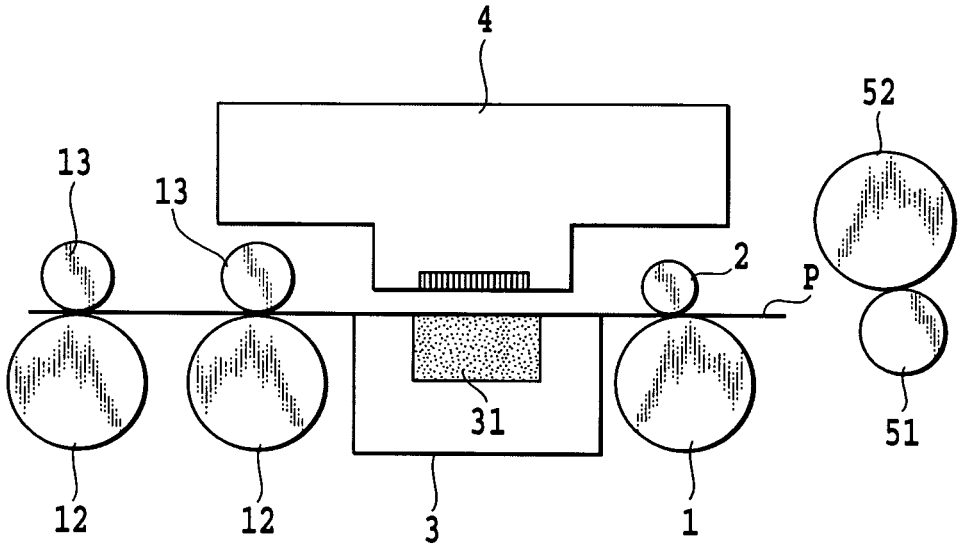
FIG. 7 a side view schematically showing the printing head, the printing medium, and the conveying mechanism for conveying the printing medium, which take part in making a printing in a central portion of the printing medium.
Figure 8:
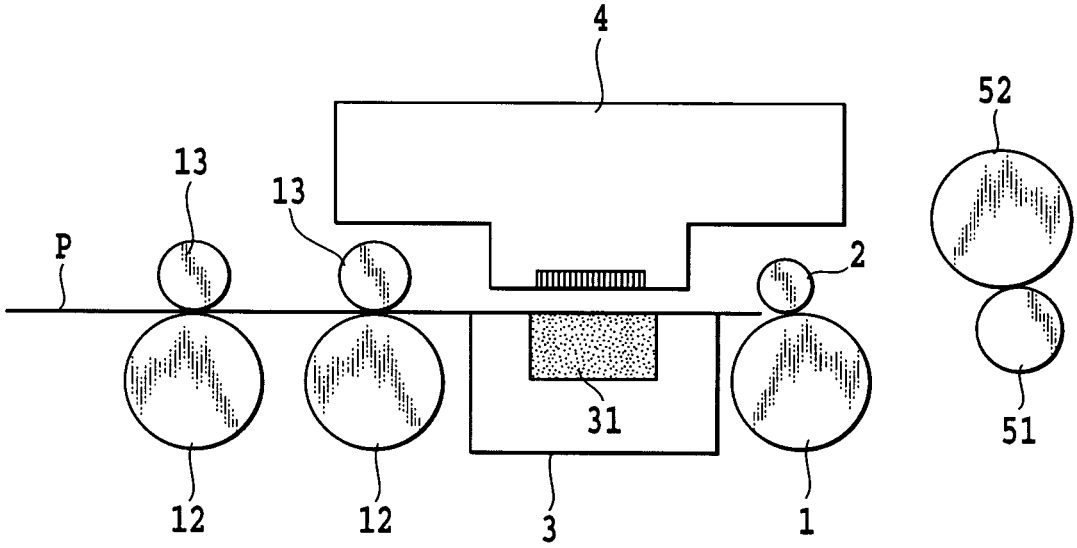
FIG. 8 is a side view schematically showing the printing head, the printing medium, and the conveying mechanism for conveying the printing medium, which take part in making a printing in a rear end portion of the printing medium.

FIGS. 6, 7 and 8 are diagrams each schematically showing the printing head, the printing medium, and the conveying mechanism for conveying the printing medium, when printings are performed on the front end portion of the printing medium, the central portion thereof and the rear end portion thereof, respectively. The printing medium 4 ejects an ink downwards from each nozzle in each nozzle array while performs reciprocating scans in a direction orthogonal to each drawing, and thus forms an image in an area on the printing medium P, which is positioned between the conveying roller 1 and the discharge roller 12. Reference numerals 51 and 52 denote paired supply rollers for feeding the printing medium to an printing area where for the printing head 4 performs a print. The platen 3 for supporting the printing medium while the printing medium is being passed the printing area has a groove, in which an ink absorber 31 is placed. The ink absorber 31 is that for receiving inks which are ejected to an area outside the front and rear ends of the printing medium as well as outside the side ends thereof while a margin-less printing is performed. The inks absorbed in the ink absorber 31 is designed to thereafter move to a waste ink absorber (not illustrated) placed under the main body of the printing apparatus. It should be noted that, although each of FIGS. 6 to 8 illustrates two pairs of rollers placed downstream in the conveyance direction, a unit pair of rollers may be instead placed there as shown in FIG. 1.

FIG. 6 shows a manner that a printing is performed on the front end portion of the printing medium P and its vicinity. While the printing is performed on the front end portion of the printing medium P and its vicinity, the printing medium P is held and conveyed by the conveying roller 1 and the pinch rollers 2 which are located upstream. In other words, while the printing is performed on the front end portion, the discharge roller 12 takes no part in conveying the printing medium P. Thereafter, the front end of the printing medium P goes into a nipping position between the discharge roller 12 and the spur rollers 13. Accordingly, the printing medium P becomes held by the discharge roller 12 and the spur rollers 13 downstream in the conveying direction as well, as shown in FIG. 7. As the printing continues after the printing medium P is held both upstream and downstream as shown in FIG. 7, the rear end of the printing medium P becomes released from a nipping position between the transfer roller 1 and the pinch rollers 2. Subsequently, the printing medium P is held and conveyed by the discharge roller 12 and the spur rollers 13 only, as shown in FIG. 8.

The printing apparatus according to the present embodiment is designed to provide an output whose image quality is equal to that of a silver-salt photograph, and is constructed as a printing apparatus capable of forming an image having no margin, or making what is termed as a "margin-less printing."

Figure 9:
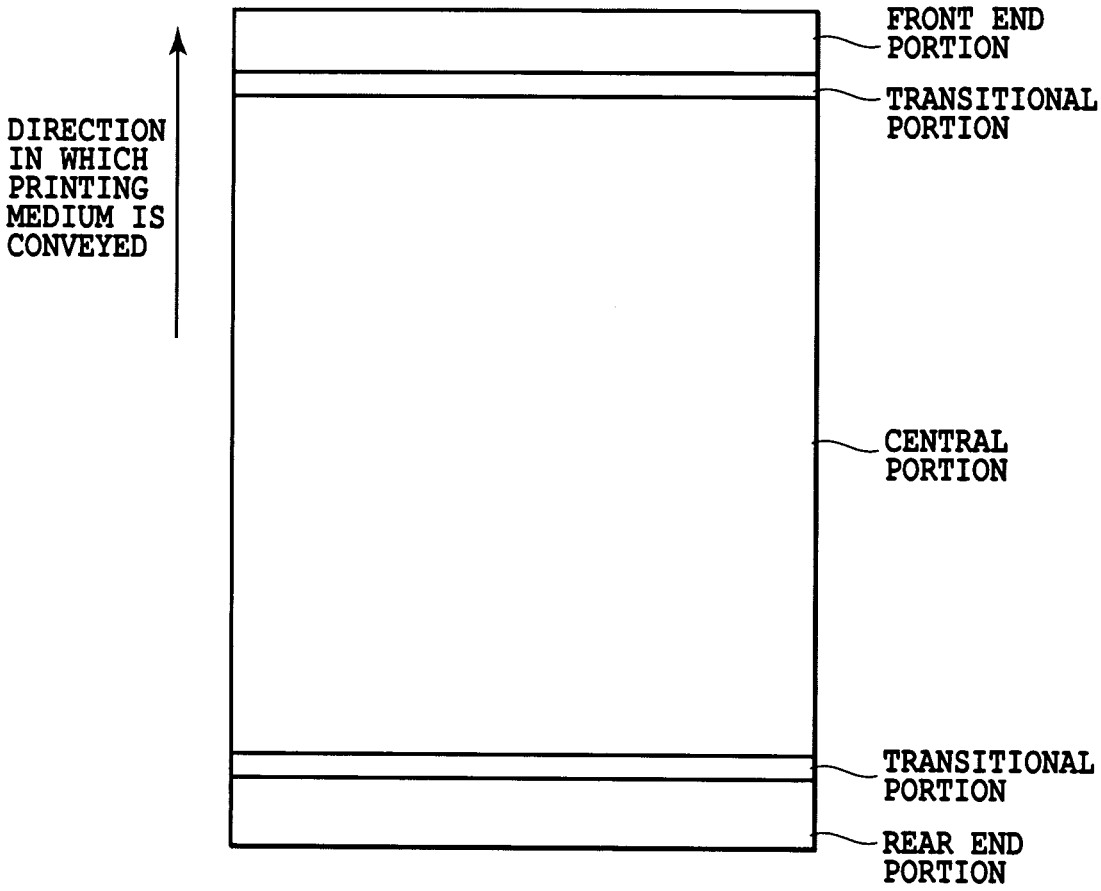
FIG. 9 is a diagram showing areas respectively of the front end portion, the central portion and the rear end portion of the printing medium on which a margin-less printing is performed.

FIG. 9 is a diagram showing the front end portion, the central portion, and the rear end portion of the printing medium, used in the printing apparatus of the present embodiment, with a predetermined size (for example, a size of 294 mm×210 mm), on which a margin-less printing is performed. As described by use of FIGS. 6 to 8, a printable area on a printing medium with the printing medium being held by both the conveying roller 1 and the discharge roller 12 is defined as a central portion of the printing medium. In addition, another area on the printing medium on which a printing is performed before the front end of the printing medium is supported by the discharge roller 12 is defined as a front end portion of the printing medium. Yet another area on which a printing is performed after the rear end portion of the printing medium is released from the conveying roller 1 is defined as a rear end portion of the printing medium.

In the present embodiment, a printing is performed on the central portion by use of all the range in each of the nozzle groups arranged in the sub-scanning direction (or in the direction in which the printing medium is conveyed), whereas a printing is performed on each of the front and rear end portions by use of nozzles included in a part of the range in each of the nozzle groups. In other words, the nozzle-use range is limited to a part of the range in each of the nozzle groups while a printing is performed on the front and rear end portions, and a distance at which the printing medium is conveyed at an interval between each two consecutive main scans is accordingly reduced.

However, while the printing proceeds from the front end portion of the printing medium to the central portion thereof, if a sudden conveyance error of approximately several tens μm takes place due to an impact which occurs when the front end goes into the nipping position between the discharge roller 12 and the spur rollers 13, the density becomes uneven when a particular printing scan is made over the front end portion. In addition, while the printing proceeds from the central portion to the rear end portion, if a sudden conveyance error of approximately several tens μm takes place due to an impact which occurs when the rear end is released from the nipping position between the conveying roller 1 and the pinch rollers 2, the density becomes uneven when a particular printing scan is made over the rear end portion.

With this taken into consideration, in the present embodiment, a transitional portion including an area where the density is likely to become uneven due to a sudden conveyance error is set up between the front end portion and the central portion, and between the central portion and the rear end portion. The following control is applied to the transitional portions thus set up. On one hand, one of the transitional portions is an area to which a gradually-expanded nozzle-use range is applied while a printing proceeds from the front end portion to the central portion. On the other hand, the other transitional portion is an area to which a gradually-reduced nozzle-use range is applied while a printing proceeds from the central portion to the rear end portion, as well.

Figure 10A:
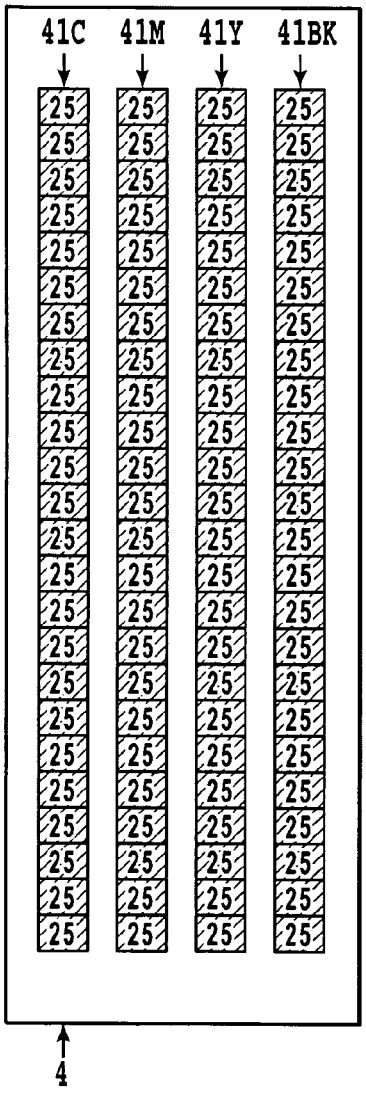
FIGS. 10A, 10B and 10C are explanatory diagrams used for explaining nozzle-use ranges applied to a central portion, transitional portions, and the front and rear end portions in the first embodiment, respectively.
Figure 10B:
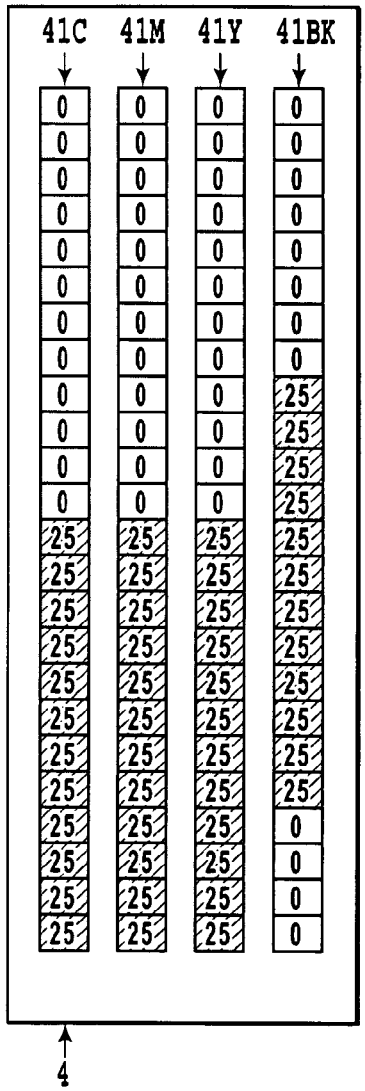
Figure 10C:
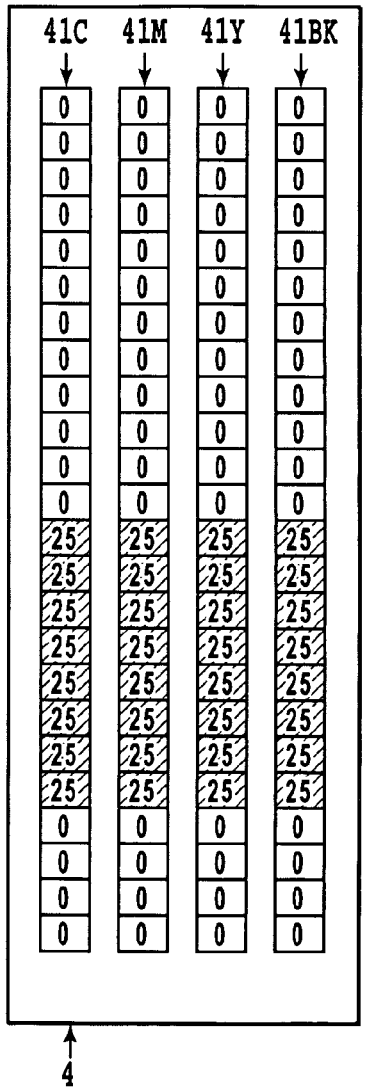

FIGS. 10A to 10C are diagrams each used to explain nozzle-use ranges respectively applied to the central portion, the transitional portions, as well as the front and rear end portions. Reference numerals 41C, 41M, 41Y and 41Bk denote nozzle arrays of cyan, magenta, yellow and black inks, respectively. For each color, 768 nozzles are divided into 24 groups each including 32 nozzles. A numeric value in each block representing each group indicates a print allowing rate of the group. This print allowing rate is equal to a value (25%) representing the print allowing rate of the mask pattern which is uniformly applied to each printing scan in the case (see FIG. 3) where the 4-pass printing operation is carried out by use of the printing head 4 in which the nozzles (see FIG. 2) are arranged with a density equal to the printing density. In addition, this printing allowing rate is equal to the print allowing rate (25%) of the mask pattern which is applied to each printing scan in the case (see FIG. 4) where an interlace printing operation is carried out by use of the printing head 4 in which the nozzles are arranged with a density equal to a quarter of the printing density. As a result, hatched nozzle groups (or groups whose print allowing rate is not equal to 0 (zero)) are nozzle-use ranges.

In the case of the prior art, when a printing is performed on the central portion, the entire range of each nozzle array belonging to each of the four colors is used for the printing. When a printing is performed on each of the front and rear end portions, a control is applied in order that the nozzle-use ranges are restricted to parts of the nozzle arrangement ranges of the respective nozzle arrays belonging to each of the four colors, the parts corresponding to one another in the main-scanning direction. In the present embodiment, similarly, the color nozzle-use ranges which are used when a printing is performed on the central portion are the same in size throughout all of the nozzle arrays of the four colors, and the positions of the nozzle-use ranges in the nozzle arrays of the four colors correspond to one another in the direction in which the nozzles are arranged (see FIG. 10A). This is also the case when a printing is performed on the front and rear end portions (see FIG. 10C). A printing performed by use of these nozzle-use ranges is defined as a first printing control. In the present embodiment, the transitional portion between the front end portion and the central portion and the transitional portion between the central portion and the rear end portion are set up in the printing medium. For each of the transitional portions, the positions of the nozzle-use ranges in the nozzle arrays 41C, 41M and 41Y of the chromatic color inks are shifted from the position of the nozzle-use range of the nozzle array 41Bk for the black (achromatic color) ink in the nozzle arrangement direction (see FIG. 10B). A printing performed by use of these nozzle-use ranges is defined as a second printing control. It should be noted that the sizes of the nozzle-use ranges used for the central portion, the transitional portions, as well as the front and rear end portions in the present embodiment are equal to the sizes of the nozzle-use ranges used for the central portion, the transitional portions, as well as the front and rear end portions in the case of the prior art, respectively. When an index of 1 (one) is assigned to the size of the overall nozzle arrangement range, the ratio of the size of the nozzle-use range in the central portion to the size of the overall nozzle arrangement range is 1 (one); the ratio in the transitional portion is ½; and the ratio in each of the front and rear end portions is ⅓. In addition, in each of the transitional portions, the nozzle-use range for the black ink is shifted from the nozzle-use ranges in the nozzle arrays for the chromatic color inks by a distance equal to ⅙ of the length of the overall nozzle arrangement range.

When a printing is performed on the front and rear end portions of a printing medium, the present embodiment prevents an image from defecting by narrowing down the printing width, or by reducing the nozzle-use ranges, and accordingly by decreasing the distance at which the printing medium is conveyed at an interval between each two consecutive main scans. Furthermore, the present embodiment shifts the positions of the nozzle-use ranges in the nozzle arrays for the chromatic color inks from the position of the nozzle-use range in the nozzle array for the black ink.

Figure 11:
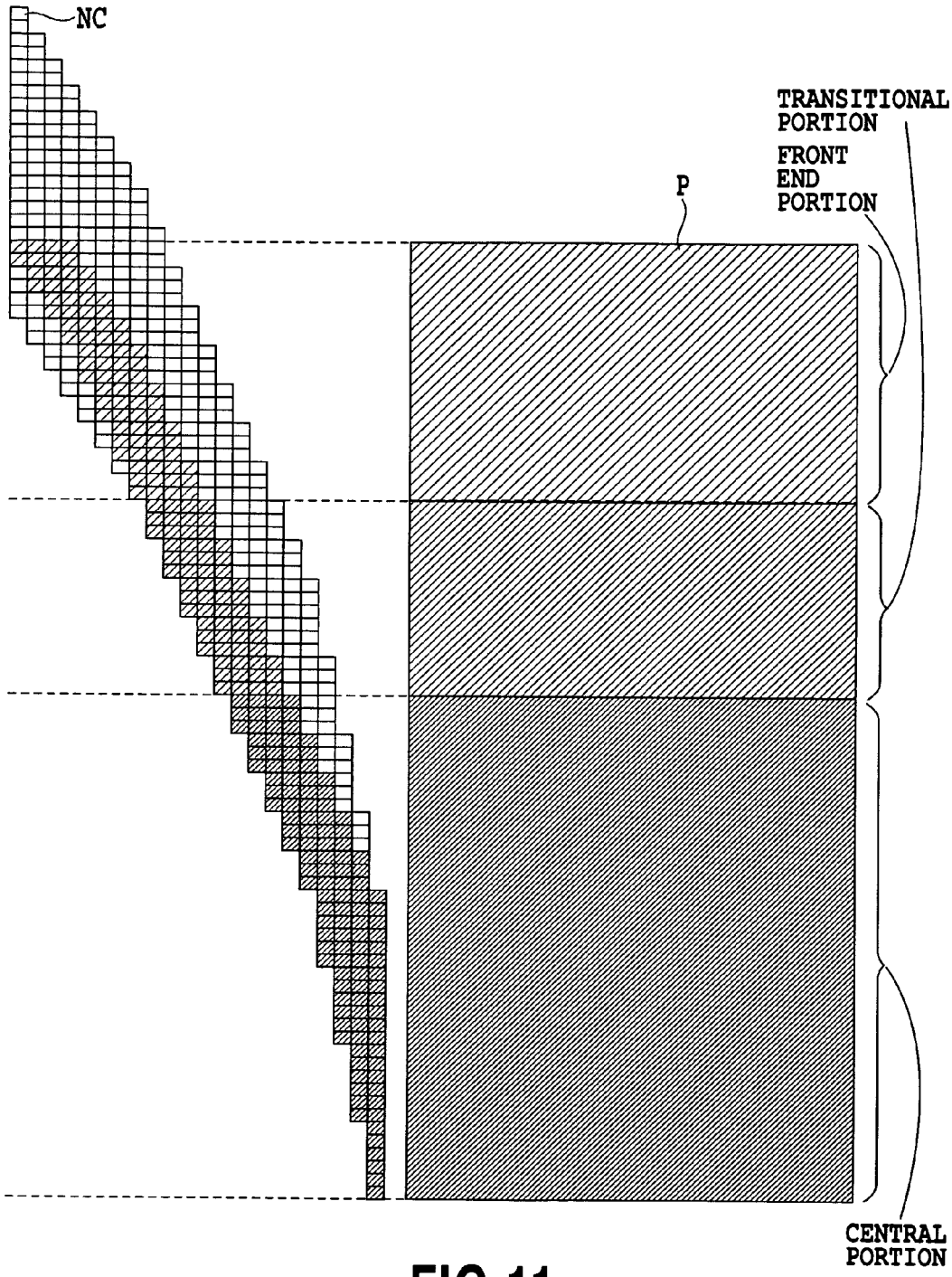
FIG. 11 is an explanatory diagram used for explaining how a nozzle array of a chromatic color ink scans, and is used, for making a printing on the front end portion of the printing medium.
Figure 12:
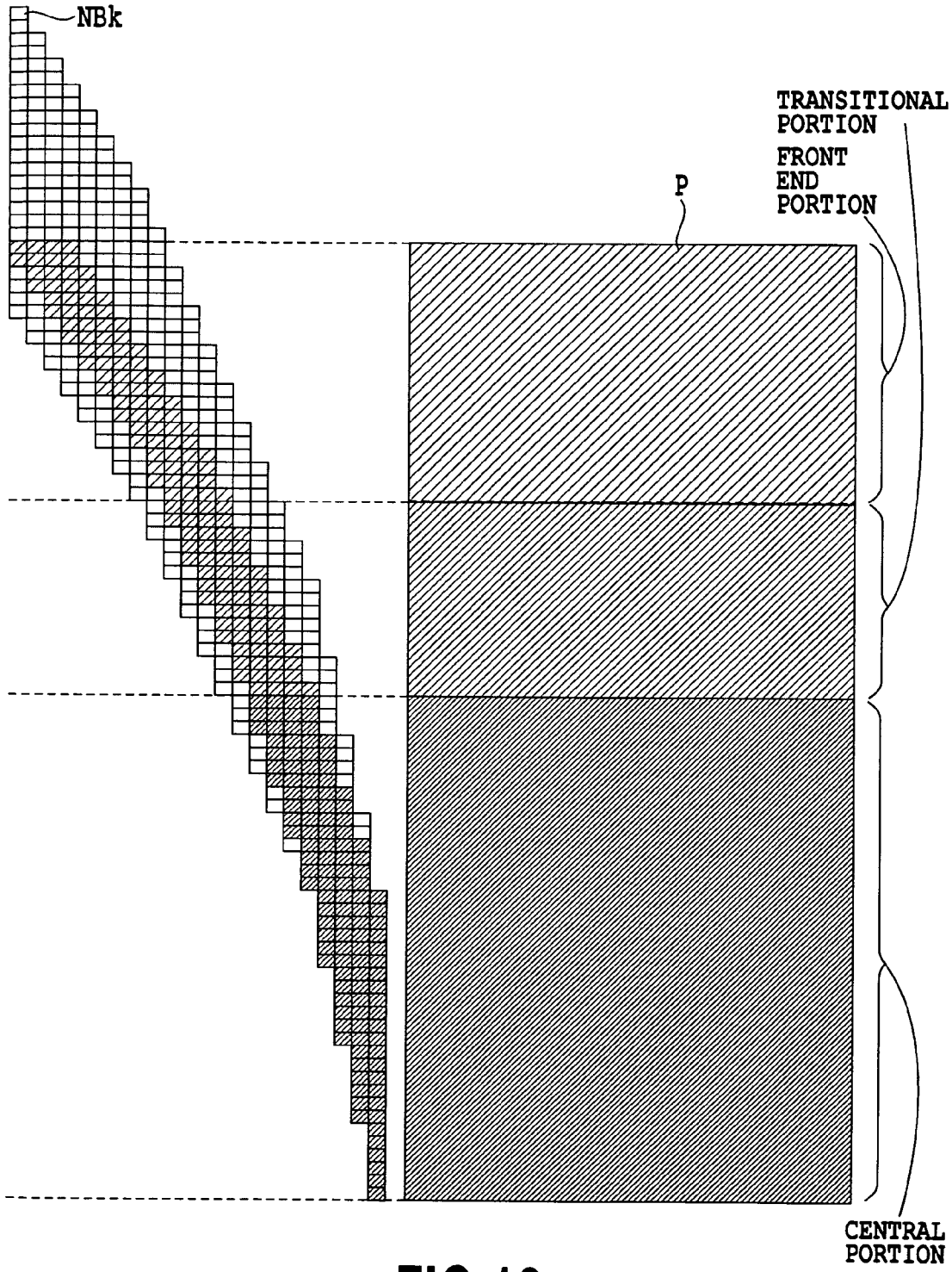
FIG. 12 is an explanatory diagram used for explaining how a nozzle array of a black ink scans, and is used, for making a printing on the front end portion of the printing medium.
Figure 13:
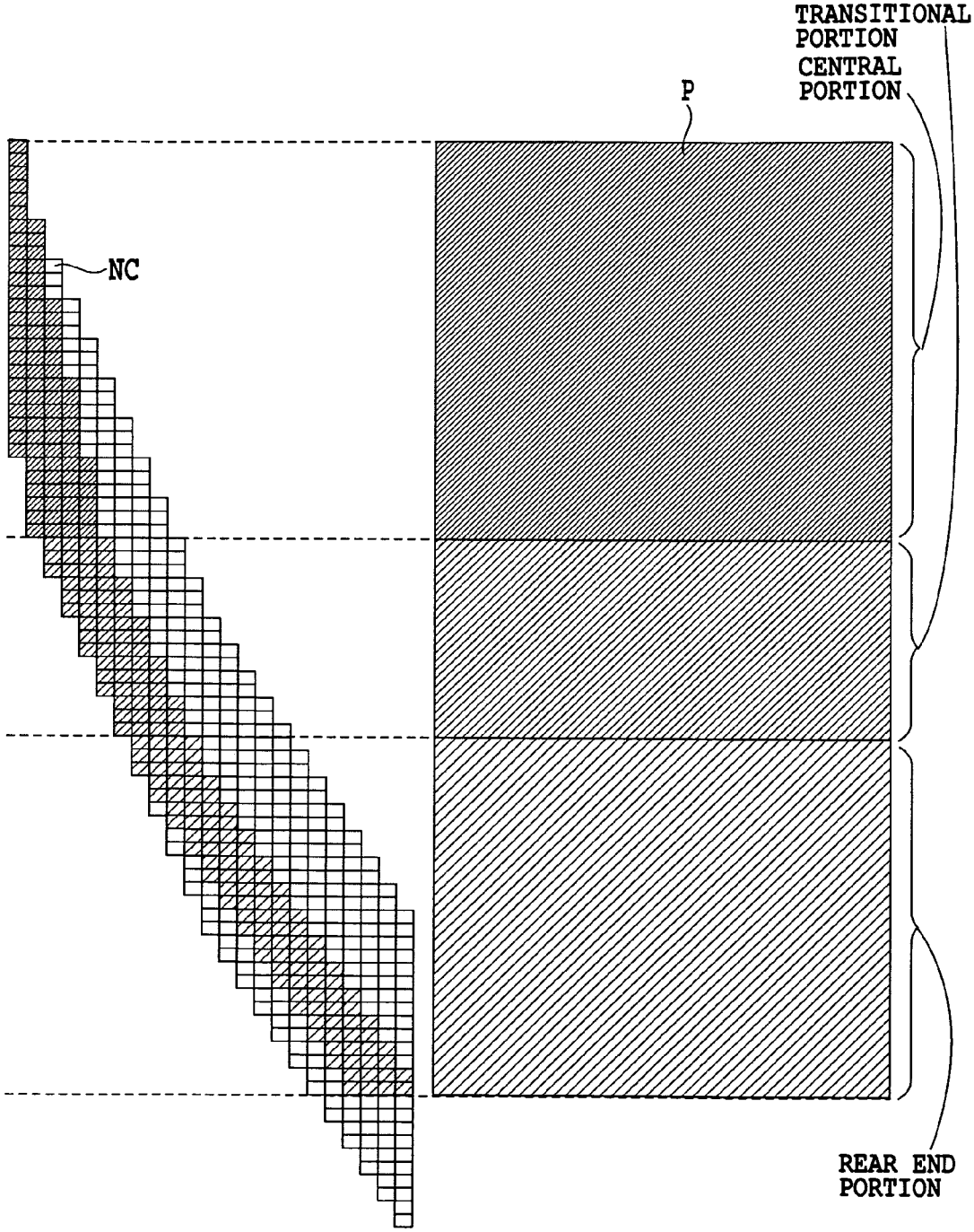
FIG. 13 is an explanatory diagram used for explaining how the nozzle array of the chromatic color ink scans, and is used, for making a printing on the rear end portion of the printing medium.
Figure 14:
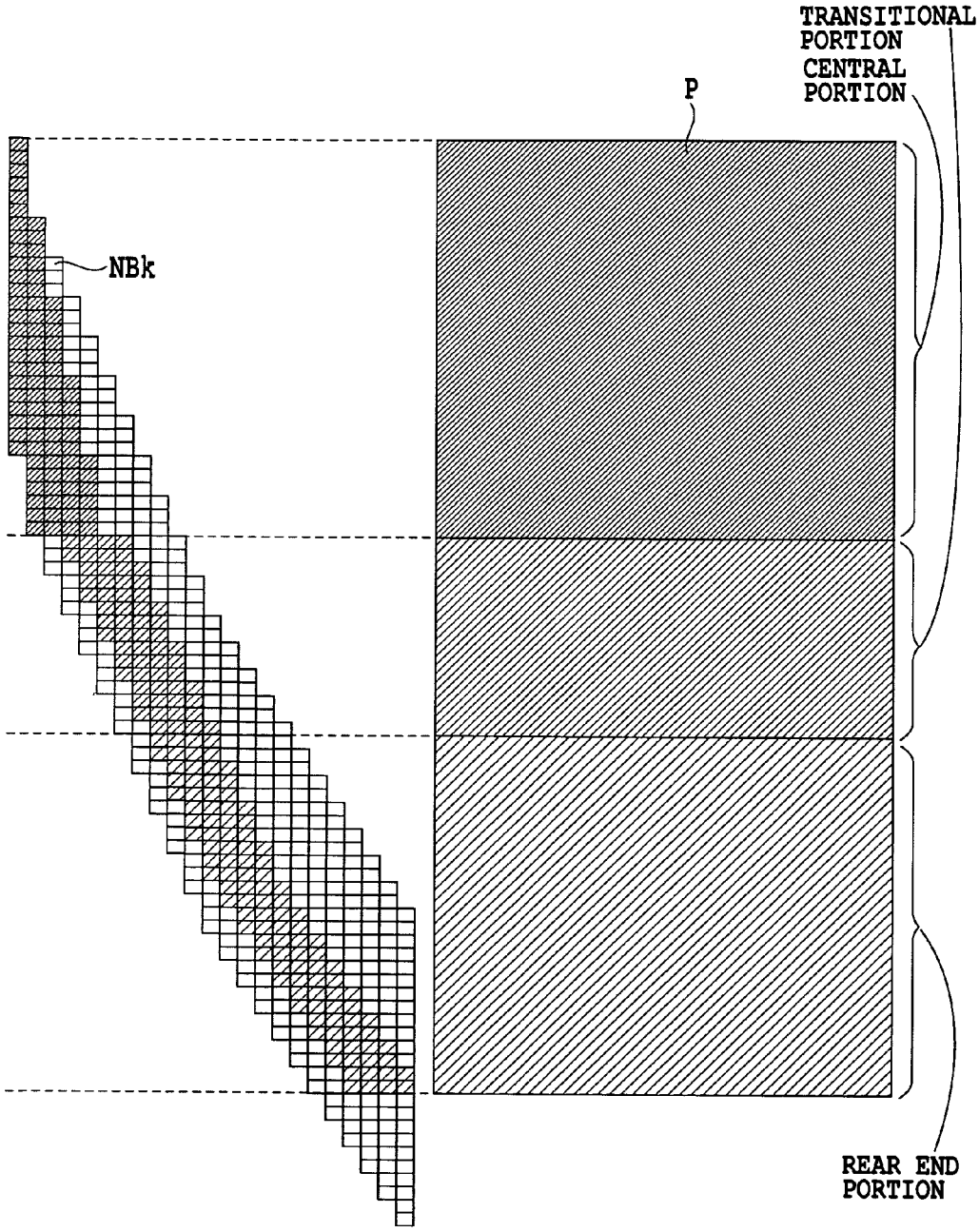
FIG. 14 is an explanatory diagram used for explaining how the nozzle array of the black ink scans, and is used, for making a printing on the rear end portion of the printing medium.

FIGS. 11 and 12 are explanatory diagrams showing how the nozzle array NC of the chromatic color ink and the nozzle array NBk of the black ink scan, and are used, when a printing is performed on the front end portion of the printing medium. These drawings show a state that the printing proceeds from the front end portion of the printing medium P to the central portion thereof through the transitional portion thereof. FIGS. 13 and 14 are explanatory diagrams showing how the nozzle array NC of the chromatic color ink and the nozzle array NBk of the black ink scan, and are used, when a printing is performed on the rear end portion of the printing medium. These drawings show a state that the printing proceeds from the central portion of the printing medium P to the rear end portion thereof through the transitional portion thereof. It should be noted that, for the purpose of making the explanation simpler, these drawings show as if the nozzle arrays (NC and NBk) were moved for each printing scan. In an actual operation, however, the positions of the nozzle arrays and the printing head 4 in the sub-scanning direction are fixed whereas the printing medium P is conveyed in the sub-scanning direction for each printing scan.

In a case where an index of 1 (one) is assigned to the size of the overall nozzle arrangement range, the ratio of the size of the nozzle-use range to the size of the overall nozzle arrangement range changes from ⅓ and ½ to 1 step-by-step while the printing proceeds from the front end portion to the central portion through the transitional portion, as shown in FIGS. 11 and 12. In addition, as clear from a comparison of FIG. 11 with FIG. 12, the nozzle-use range in the nozzle array NBk for the black ink is shifted from the nozzle-use ranges in the nozzle arrays NC for the chromatic color inks by a distance equal to ⅙ of the length of the overall nozzle arrangement range. The ratio of the size of the nozzle-use range to the size of the overall nozzle arrangement range changes from 1 and ½ to ⅓ step-by-step while the printing proceeds from the central portion to the rear end portion through the transitional portion, as shown in FIGS. 13 and 14. In addition, as clear from a comparison of FIG. 13 with FIG. 14, the nozzle-use range in the nozzle array NBk for the black ink is shifted from the nozzle-use range in the nozzle array NC for the chromatic color ink by a distance equal to ⅙ of the length of the overall nozzle arrangement range.

Figure 15:
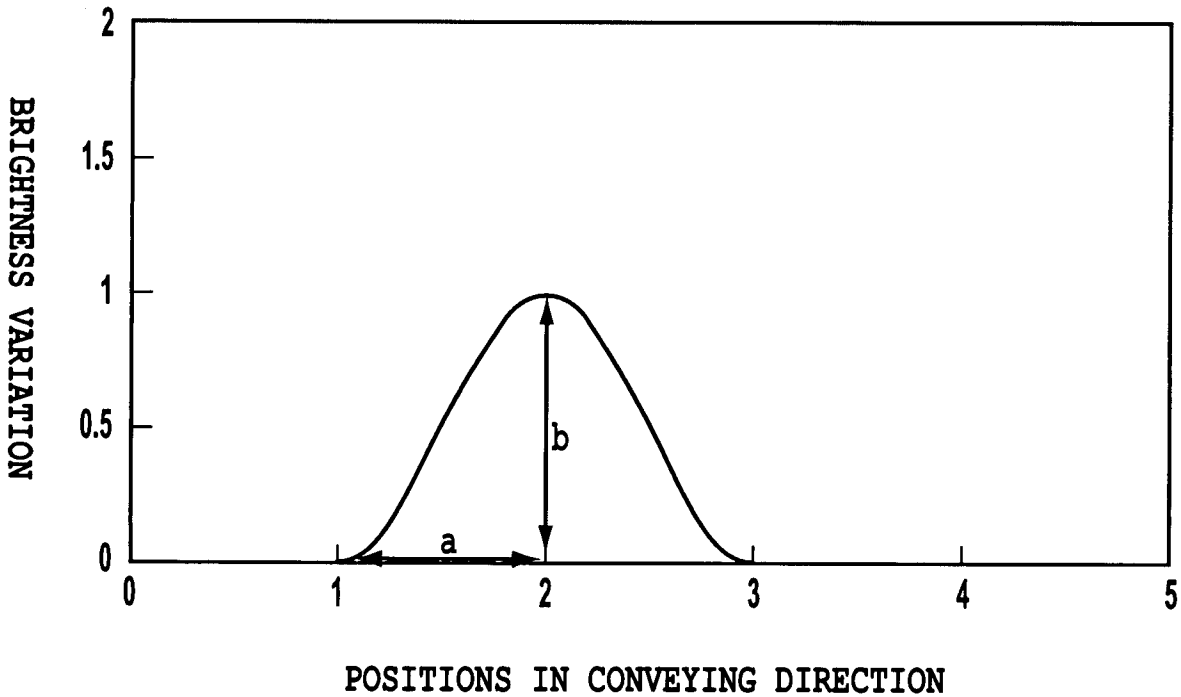
FIG. 15 is an explanatory diagram showing a relationship between positions in the direction in which the printing medium is conveyed and brightness variation stemming from a sudden conveyance error in a case where a printing is performed by use of all of the color inks.

FIG. 15 shows a relationship between positions in the direction in which the printing medium is conveyed and brightness variation stemming from a sudden conveyance error in a case where a multi-pass printing is performed by use of all kinds of the four colors under the application of the prior art. Specifically, the "brightness variation" indicates an amount (the absolute value of an amount) of variation of brightness from a reference brightness indicating brightness in a printing area where no density unevenness takes place. For this reason, a larger value in the axis of ordinates in FIG. 15 has nothing to do with a higher brightness. As clear from the following descriptions, in a printing area where density unevenness takes place due to a sudden conveyance error, the brightness varies to a larger extent because positions where the respective color ink dots are formed are deviated.

Such a sudden conveyance error takes place, for example, when the front end of a printing medium goes into the nipping position between the discharge roller 12 and the spur rollers 13, or when the rear end of the printing medium becomes released from the nipping position between the conveying roller 1 and pinch rollers 2. In the former case, a distance at which the printing medium is conveyed tends to momentarily decrease because the printing medium receives a resistance from the nipping position between the discharge roller 12 and the spur rollers 13 (or a minus error takes place). In the latter case, a distance at which the printing medium is conveyed tends to momentarily increases because the printing medium is accelerated in the conveyance direction (or a plus error takes place). In the cases of the multi-pass printing method and the interlace printing method, the density of an image becomes lower (brightness becomes higher) when such a plus or minus error takes place than when no such error takes place. The reason for this is as follows. An area factor of dots constituting an image is at its maximum while no conveyance error takes place. As a result, once a conveyance error takes place, the area factor of dots constituting an image decrease whether the conveyance error may be a plus one or a minus one. In response to this, the density becomes lower (brightness becomes higher).

Strictly speaking, a force which is applied to the printing medium in the case where the front end thereof goes into the nipping position between the discharge roller 12 and the spur rollers 13 is different from a force which is applied to the printing medium in the case where the rear end thereof becomes released from the nipping position between the conveying roller 1 and the pinch rollers 2. The waveform (including the shape and the amplitude) of brightness variation is different between the two cases. However, the tendencies respectively of the two forces are similar to each other. For this reason, the brightness variation curve of FIG. 15 is applicable to the two cases. In FIG. 15, the brightness variation is indexed by assigning an index of 1 (one) to the maximum value of the brightness variation which takes place when a printing is performed by use of the inks respectively of all of the four colors.

In this respect, examples of a quantitative evaluation factor for the density unevenness include a gradient of the brightness variation ("Evaluation Factor 1") and a peak value of the brightness variation ("Evaluation Factor 2"). Specifically, as shown in FIG. 15, the "Evaluation Factor 1" is defined as a value obtained by dividing a peak value b by a length a between a position at which the brightness starts to vary (or a position corresponding to "1 (one)" in the axis of abscissas representing the conveyance direction and a position at which the brightness variation is at its peak (or at a position corresponding to "2" in the axis of abscissas. That is, "Evaluation Factor 1"=b/a.

In addition, the "Evaluation Factor 2" is defined as the peak value of the brightness variation. That is, "Evaluation Factor 2"=b.

A panel test has proved that these evaluation factors almost agree with a result of visible evaluation of the brightness variation. One may consider that the density unevenness becomes more obvious as the values representing these evaluation factors become larger.

In a case where the ranges used in the respective nozzle arrays NC for the chromatic color inks and the range used in the nozzle array NBk of the black ink correspond to each other in the main-scanning direction while a printing is performed on an area corresponding to the transitional portion of the printing medium, the brightness varies in the corresponding printing positions in the main-scanning direction throughout all of the four inks when a sudden conveyance error takes place. As a result, in a case where an image is printed by use of all kinds of the chromatic color (or cyan, magenta and yellow) inks and the black ink, the density unevenness of the image is more obvious.

Figure 16:
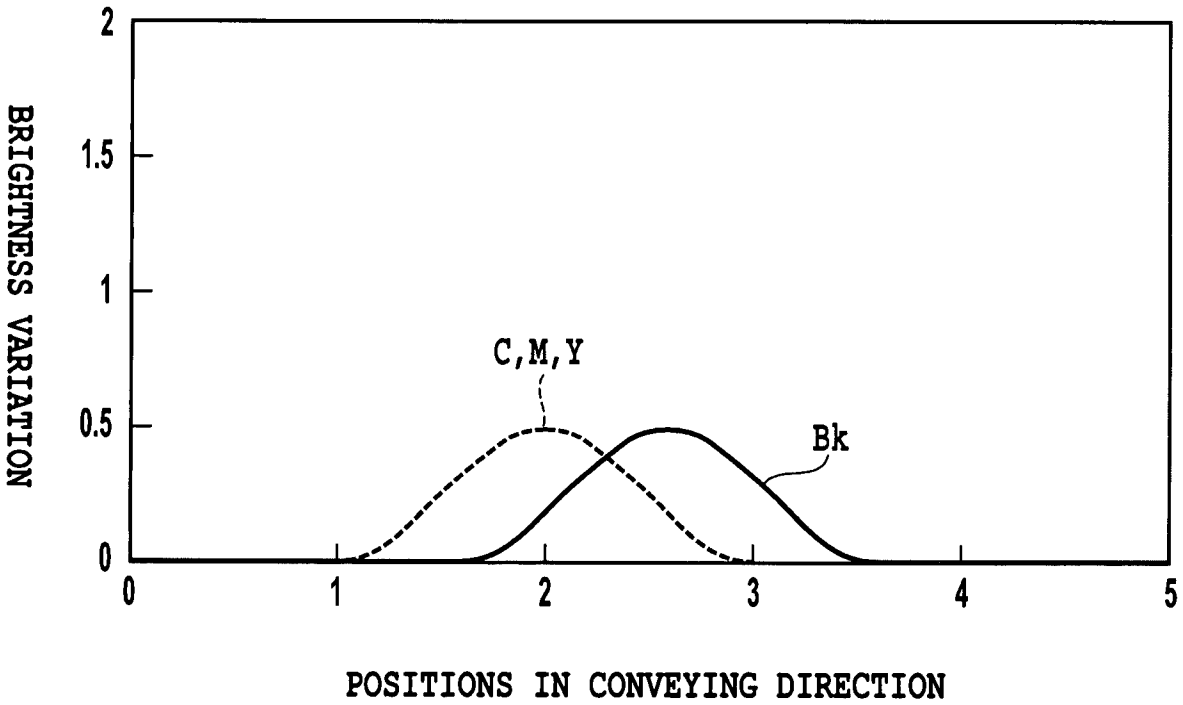
FIG. 16 is an explanatory diagram showing a relationship between the position of the printing medium in the conveyance direction and brightness variations stemming from a sudden conveyance error in a case where the first embodiment is applied.

FIG. 16 shows a relationship between the position of the printing medium in the conveyance direction and brightness variation stemming from a sudden conveyance error under the application of the first embodiment to the multi-pass printing. In this respect, it is assumed that the influence of the sudden conveyance error on the brightness variations respectively in areas on which a printing is performed by use of the three of the cyan, magenta and yellow inks is the same as the influence of the sudden conveyance error on the brightness variation in an area on which a printing is performed by use of the black ink. In this case, the maximum value of the brightness variation in the area on which the printing is performed by use of the three of the cyan, magenta and yellow inks is 0.5 whereas the maximum value of the brightness variation in the area on which the printing is performed by use of the black ink is 0.5, because the index of 1 has been assigned to the maximum value of the brightness variation in the example shown in FIG. 15. In the present embodiment, the positions of the nozzles in each nozzle array NC and the positions of the nozzles in nozzle array NBk are shifted from each other to be used for performing the printing on the transitional portions of the printing medium. This scheme shifts the peak of the brightness variation in the area on which the printing is performed by use of the black ink from the peak of the brightness variation in the area on which the printing is performed by use of the chromatic color inks when a sudden conveyance error takes place.

Figure 17:
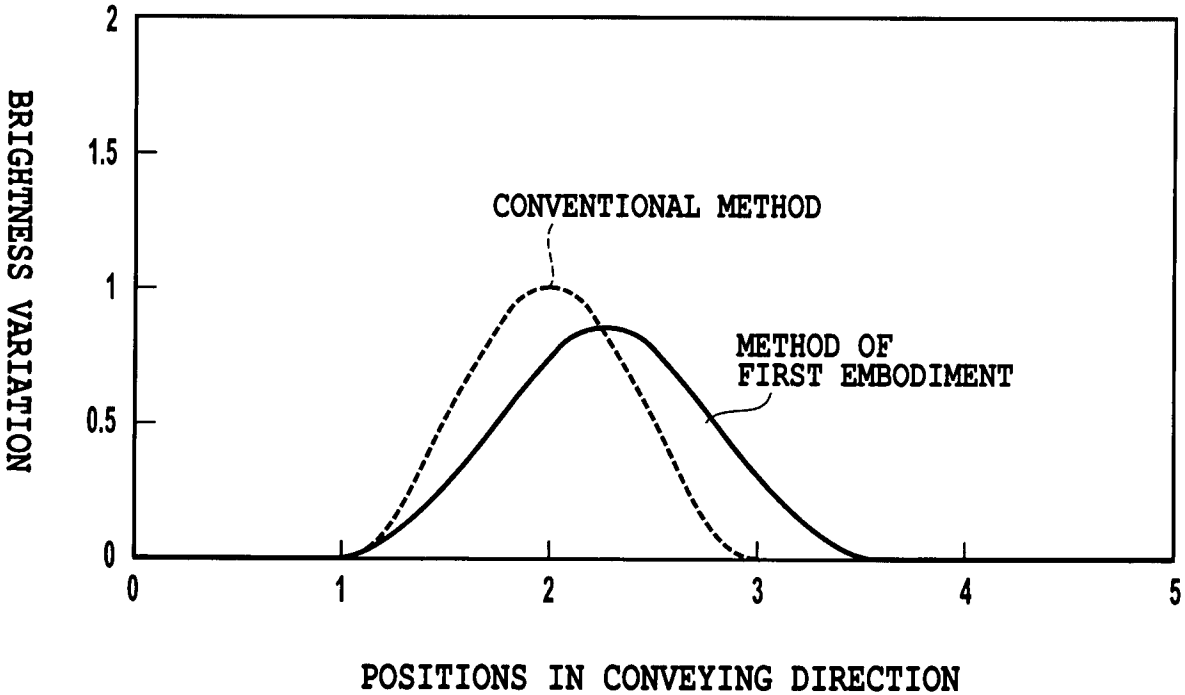
FIG. 17 is an explanatory diagram showing a relationship between positions in the direction in which the printing medium is conveyed and brightness variation in a case where the prior art is applied, and a relationship between positions in the direction in which the printing medium is conveyed and brightness variation in a case where the first embodiment is applied.

FIG. 17 shows a relationship between positions in the direction in which the printing medium is conveyed and brightness variation in a case where the prior art is applied, and a relationship between positions in the direction in which the printing medium is conveyed and brightness variation in a case where the present embodiment is applied. The application of the present embodiment is capable of shifting the location where the brightness varies when the printing is performed by use of the chromatic color inks from the location where the brightness varies when the printing is performed by use of the black ink. The overall brightness variation resulting from the combining of the former brightness variation with the latter brightness variation is indicated by the bold solid line in FIG. 17. In sum, the application of the present embodiment increases the width of the overall brightness variation, and accordingly decreases the gradient (represented by Evaluation Index 1) of the overall brightness variation, in comparison with the application of the prior art (indicated by the broken line in FIG. 17). Furthermore, the application of the present embodiment makes the position of the peak of the brightness variation different among the four colors, and accordingly reduces the absolute value (or Evaluation Index 2) of a value obtained by combining the peak values of the brightness variations concerning the respective four colors as well.

It should be noted that, actually, the combination of the brightness variations of the respective four colors does not fully agree with the overall brightness variation of all of the four colors. That is because no consideration is taken for a cause of the brightness variation which occurs in each of the four colors when dots of the same color overlap one another. Nevertheless, the influence of this cause on the brightness variation is considerably smaller than the influence of the sudden conveyance error on the brightness variation. One may consider that the application of the present embodiment without ignoring this cause qualitatively brings about the foregoing effect.

Figure 18:
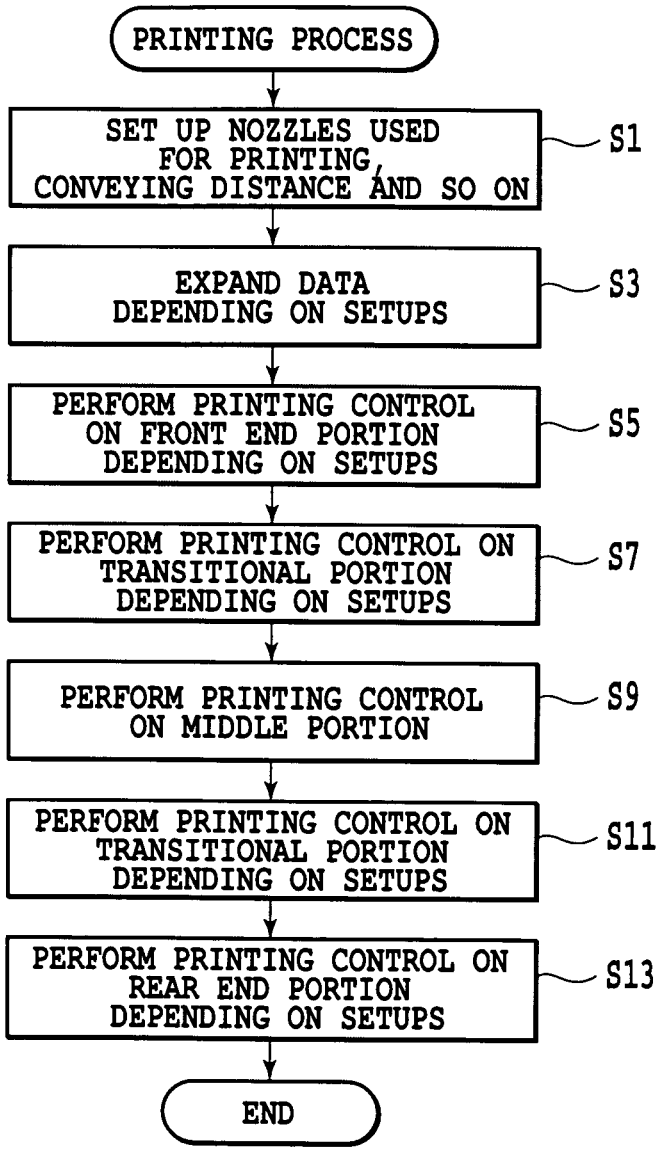
FIG. 18 is a flowchart showing an example of a printing process procedure carried out by the printing apparatus according to the first embodiment.

FIG. 18 shows an example of a printing process procedure carried out by the printing apparatus according to the present embodiment.

In the case of the procedure, first of all, the nozzle-use ranges and the corresponding distance at which a printing medium should be conveyed at an interval between each two consecutive main scans are set up for each of the front end portion, the central portion, the rear end portion, and the two transitional portions of the printing medium (in step S1). Subsequently, data is expanded depending on the setups (in step S3). Thereafter, a printing operation is performed on the front end portion, one of the two transitional portion, the central portion, the other of the two transitional portion, and the rear end portion thereof in accordance with the respective setups (in steps S5, S7, S9, S11 and S13). In this respect, printing controls made in steps S5, S9 and S13 are categorized as corresponding to the first printing control, and printing controls made in steps S7 and S11 are categorized as corresponding to the second printing control.

It should be noted that the present embodiment can be variously modified as follows.

First of all, the nozzle-use ranges in the nozzle arrays for all of the four colors used for making a printing on the central portion thereof may be set smaller than the nozzle arrangement ranges of the color nozzle arrays, and concurrently the positions of the nozzle-use ranges of the nozzle arrays NC for the chromatic color inks may be shifted from the position of the nozzle-use range in the nozzle array NBk for the black ink (modification 1). In a case where, for example, a printing is requested to be made with a specifically high resolution, a possible conveyance error is intended to be reduced by decreasing the nozzle-use ranges in the respective nozzle arrays used for performing the printing on the central portion. In this case, if the positions of the reduced nozzle-use ranges in the nozzle arrays NC used for performing the printing on the central portion by use of the chromatic color inks are shifted from the position of the reduced nozzle-use range in the nozzle array NBk used for performing the printing on the same central portion by use of the black ink, it is possible to reduce the influence of a sudden conveyance error on the image quality even when the sudden conveyance error takes place due to an accidental vibration while the printing is performed. In this case, $$n2 \leqq N - n1$$

can be satisfied, where N denotes the number of nozzles corresponding to the overall nozzle arrangement range, n1 (a divisor of N) denotes the number of nozzles corresponding to the reduced nozzle-use range, and n2 (a divisor of N) denotes the number of nozzles corresponding to the amount of shifting the reduced nozzle-use ranges for the chromatic color inks from the reduced nozzle-use range for the black ink.

Furthermore, in a case where the nozzle-use range used for printing on the front or rear end portion is narrower than the width of the absorbing body 31, the nozzle-use ranges for the chromatic color inks may be shifted from the nozzle-use range for the black ink as in the case where a printing is performed on the two transition portions (modification 2). In this respect, $$n2 \leqq n3 - n1$$

can be satisfied, where n3 (a divisor of N) denotes the number of nozzles corresponding to the width of the absorbing body.

Another modification (modification 3) of the present embodiment is applicable to an inkjet printing apparatus and method using a head which is configured to include nozzle arrays consisting of nozzles whose diameters are different from one nozzle array to another, and to be capable of forming dots with the mutually different diameters on a printing medium, instead of the head in which the nozzles with the single diameter are arranged as shown in FIG. 2. Examples of such a head includes a head provided with a nozzle array consisting of nozzles with a large-sized diameter, a nozzle array consisting of nozzles with a middle-sized diameter, and a nozzle array consisting of nozzles with a small-sized diameter, for the black ink. In the case of this head, a scheme may be used, for example, in which the nozzle-use range in the nozzle array consisting of nozzles with the large-size diameter for the black color is shifted from the nozzle-use ranges in the nozzle arrays for the other colors by p1 ($p1 \leqq n2$), the nozzle-use range in the nozzle array consisting of nozzles with the middle-sized diameter for the black color is shifted from the nozzle-use ranges in the nozzle arrays for the other colors by p2 ($p2 \leqq n2$), and the nozzle-use range in the nozzle array consisting of nozzles with the small-sized diameter for the black color is shifted from the nozzle-use ranges in the nozzle arrays for the other colors by p3 ($p3 \leqq n2$).

Moreover, yet another modification (modification 4) of the present embodiment is applicable to an inkjet printing apparatus and method using a head which is configured to include nozzle arrays each for ejecting ink of similar color with different density. Examples of such a head includes a head which has three kinds of nozzle arrays including nozzle array for the black (Bk) ink, nozzle array for a grey (Gy) ink, and nozzle array for a light grey (LGy) ink. In the case of this head, a scheme may be used, for example, in which the nozzle-use range in the nozzle array for the black color is shifted from the nozzle-use ranges in the nozzle arrays for the other colors by q1 ($q1 \leqq n2$), the nozzle-use range in the nozzle array for the grey color is shifted from the nozzle-use ranges in the nozzle arrays for the other colors by q2 ($q2 \leqq n2$), and the nozzle-use range in the nozzle array for the light gray color is shifted from the nozzle-use ranges in the nozzle arrays for the other colors by q3 ($q3 \leqq n2$).

In addition, two or more of the foregoing embodiment and modifications 1 to 4 may be combined whenever deemed necessary. Furthermore, the combined use of two or more of the foregoing embodiment and modifications 1 to 4 may be changed depending on a desired printing quality and the type of printing medium used for printing, whenever deemed necessary.

(Second Embodiment)

Figure 19A:
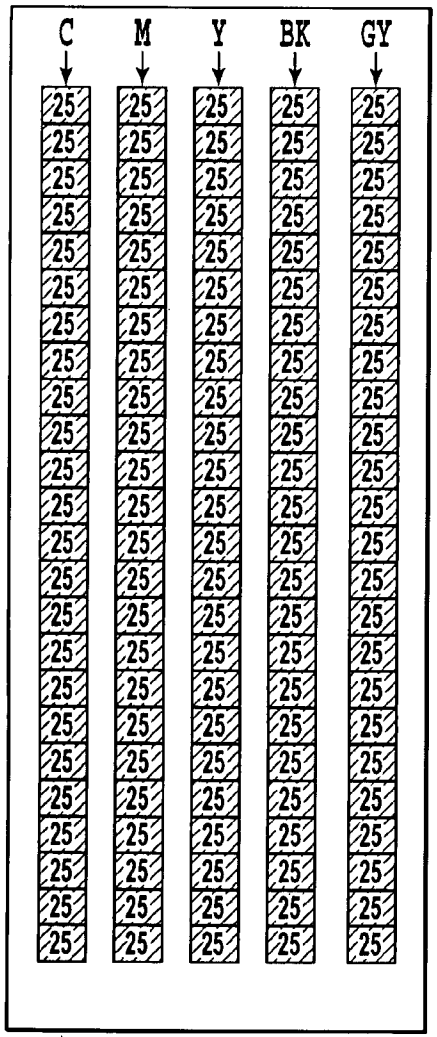
FIGS. 19A, 19B and 19C are explanatory diagrams used for explaining nozzle-use ranges applied to a central portion, transitional portions, and a front and a rear end portions in a case of a second embodiment, respectively.
Figure 19B:
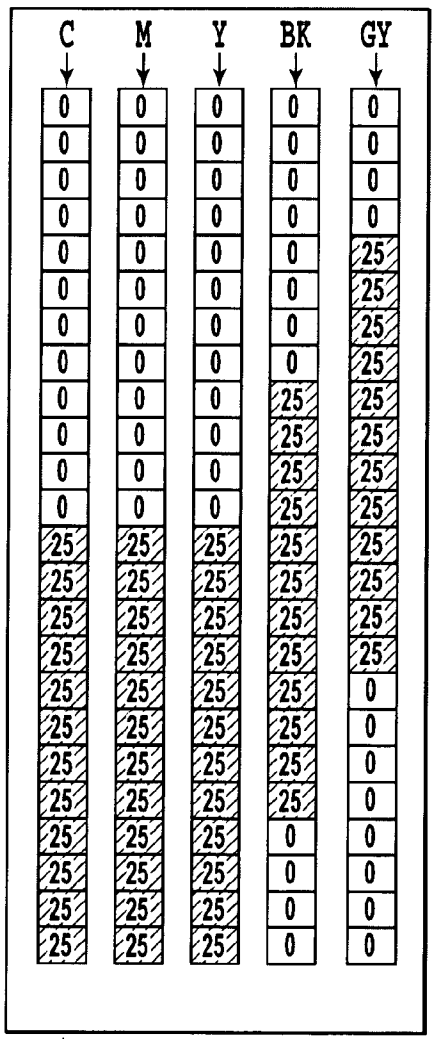
Figure 19C:
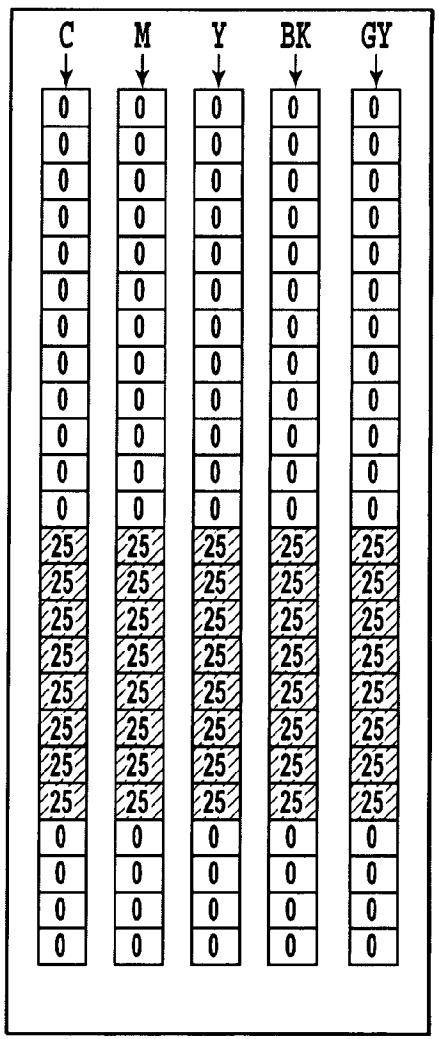

FIGS. 19A, 19B and 19C are diagrams each showing a configuration of nozzle arrays in a printing head adopted for a second embodiment of the present invention, and concurrently each used for explaining how the nozzles are used for the central portion, the transitional portions, as well as the front and rear end portions. The printing head according to the present embodiment includes nozzle array 41Gy for the grey (Gy) ink in addition to nozzle arrays 41C for the cyan ink, nozzle array 41M for the magenta ink, nozzle array 41Y for the yellow ink, and nozzle array 41Bk for the black ink. The number of nozzles in each nozzle array, a density with which the nozzles are arranged in the printing head, and the grouping of the nozzles in the printing head are the same as those in the first embodiment. A numeric value in each block representing each group indicates a print allowing rate of the group. Hatched nozzle groups (or groups whose print allowing rate is not equal to 0 (zero)) belong to nozzle-use ranges.

In the first embodiment, the nozzle-use range with the same size is used for the four colors in all the middle, front and rear end portions of the printing medium, as well as the transitional portions, whereas the position of the nozzle-use range for the Bk ink in the nozzle arrays is shifted from those for the chromatic color inks in the transitional portions. In the present embodiment, similarly, the nozzle-use range with the same size and at the relatively identical position is used for all the four colors, for the middle, front and rear end portions of the printing medium. In the present embodiment, for the transitional portions, the nozzle-use ranges at the relatively different positions are used in the nozzle array 41Bk for the Bk ink, the nozzle array 41Gy for the Gy ink, and the nozzle arrays for the chromatic color inks. In the example shown in FIGS. 19A to 19C, when an index of 1 (one) is assigned to the size of the overall nozzle arrangement range, the ratio of the size of the nozzle-use range to the size of the overall nozzle arrangement range is 1 (one) in the central portion whereas the ratio is ⅓ in each of the front and rear end portions, in common with the first embodiment. For each of the transitional portions, the size of each of the used nozzle-use ranges is limited to ⅓ of the size of the nozzle arrangement range. In addition, the position of the nozzle-use range of the nozzle array 41Bk for the BK ink and the position of the nozzle-use range of the nozzle arrays 41Gy for the Gy are shifted from the positions for the chromatic color inks by distance equal to ⅙ and ⅓ of the length of the overall nozzle arrangement range, respectively.

Figure 20:
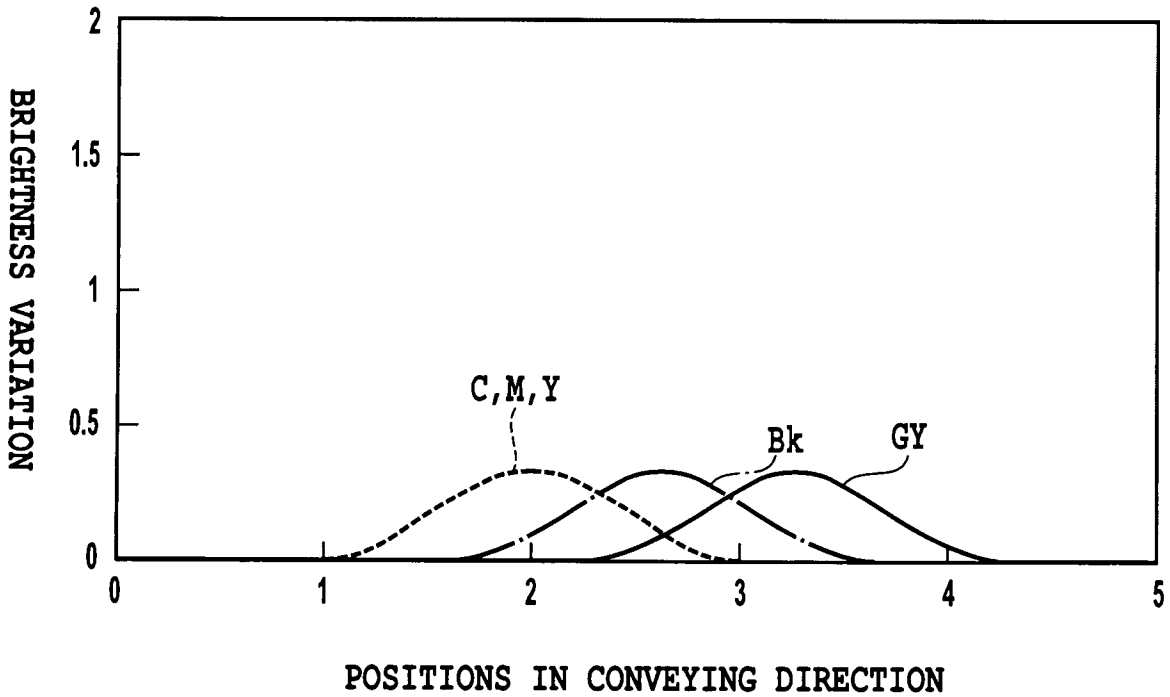
FIG. 20 is an explanatory diagram showing a relationship between positions in the direction in which the printing medium is conveyed and brightness variations stemming from a sudden conveyance error in a case where a second embodiment is applied.

FIG. 20 shows a relationship between positions in the direction in which a printing medium is conveyed and each of brightness variations which takes place respectively in an area where a printing is performed by use of the chromatic colors (C, M and Y), an area where a printing is performed by use of the Bk, and an area where a printing is performed by use of the Gy, when a sudden conveyance error occurs in the case of the inkjet printing apparatus and method to which the present embodiment is applied. In this embodiment, because the three types of nozzle-use ranges are set up for each of the transitional portions, when an index of 1 (one) is assigned to the maximum value of the overall brightness variation in each of the transitional portions, the maximum value of the brightness variation in each of the three areas is ⅓.

Figure 21:
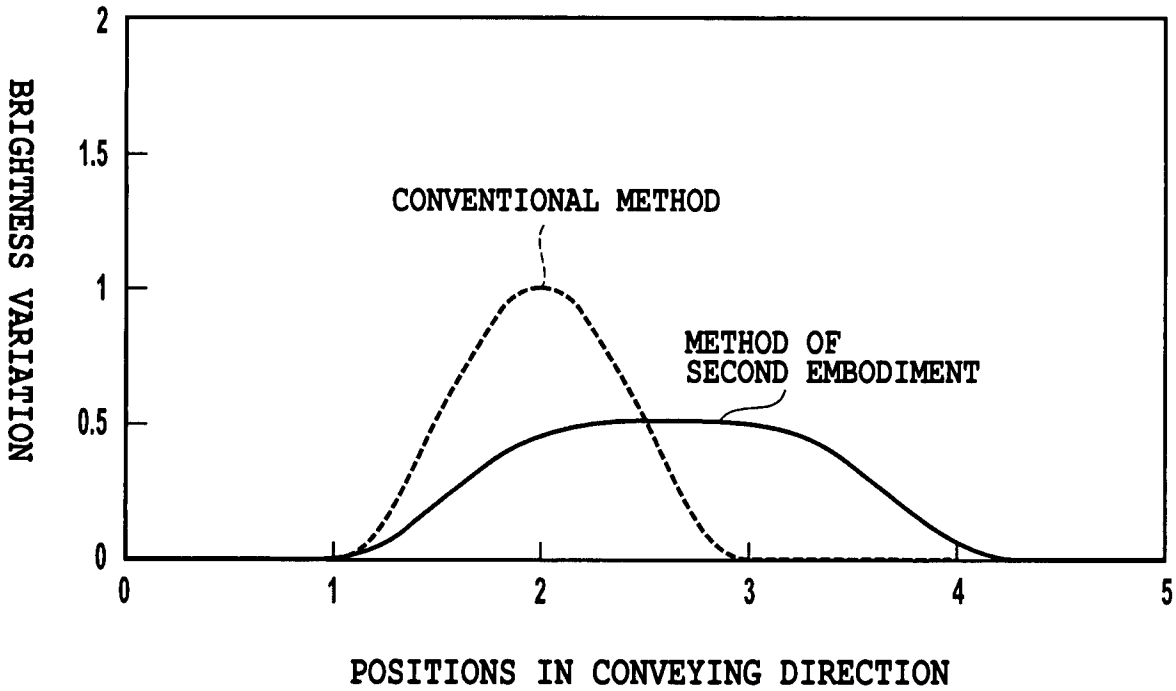
FIG. 21 is an explanatory diagram showing the relationship between positions in the direction in which the printing medium is conveyed and brightness variation in the case where the prior art is applied, and a relationship between positions in the direction in which the printing medium is conveyed and brightness variation in a case where the second embodiment is applied.

FIG. 21 shows the relationship between positions in the direction in which the printing medium is conveyed and brightness variation in the case of the inkjet printing apparatus and method to which the prior art is applied, and a relationship between positions in the direction in which the printing medium is conveyed and brightness variation in the case of the inkjet printing apparatus and method to which the present embodiment is applied. The application of the present embodiment is capable of making the location where brightness varies different among the chromatic color inks, the Bk ink and the Gy ink. For this reason, the overall brightness variation resulting from the combining of the three brightness variations with each other is indicated by the bold solid line in FIG. 21. In sum, the application of the present embodiment increases the width of the overall brightness variation, and accordingly decreases the gradient (represented by Evaluation Index 1) of the overall brightness variation, in comparison with the application of the prior art (indicated by broken line in FIG. 21). Furthermore, the application of the present embodiment makes the position of the peak of the brightness variation different among the five colors, and accordingly reduces the absolute value (or Evaluation Index 2) of a value obtained by combining the peak values of the brightness variations concerning the respective five colors as well.

In this respect, in a case where the number of nozzles used for the nozzle-use range is different from one color to another, the position where the brightness variation in any one of the five colors is at its maximum may be arranged to be the same as the position where the brightness variation in any other of the five colors. It should be noted that this arrangement is capable of reducing the gradient (represented by Evaluation Factor 1) of the overall brightness variation, but leaves the maximum value (or Evaluation Factor 2) of the overall brightness variation almost unchanged.

(Third Embodiment)

Each of the foregoing embodiments shifts the position of the nozzle-use range in the nozzle array for the specific (or black) ink from the positions of the nozzle-use ranges in the nozzle arrays for the other color inks (or the chromatic color inks), and makes the size of the nozzle-use range for the black ink different from the size of the nozzle-use ranges for the chromatic color inks, when these nozzle-use ranges are used for each of the transitional portions. However, the present invention shall not be limited to the foregoing embodiments if there is another embodiment which is capable making the position of the peak of the brightness variation different among each colors in transitional portion by expanding the width of the overall brightness variation, and accordingly of reducing the absolute value of a value obtained by combining the peak values of the brightness variations concerning the respective colors as well.

Figure 22C:
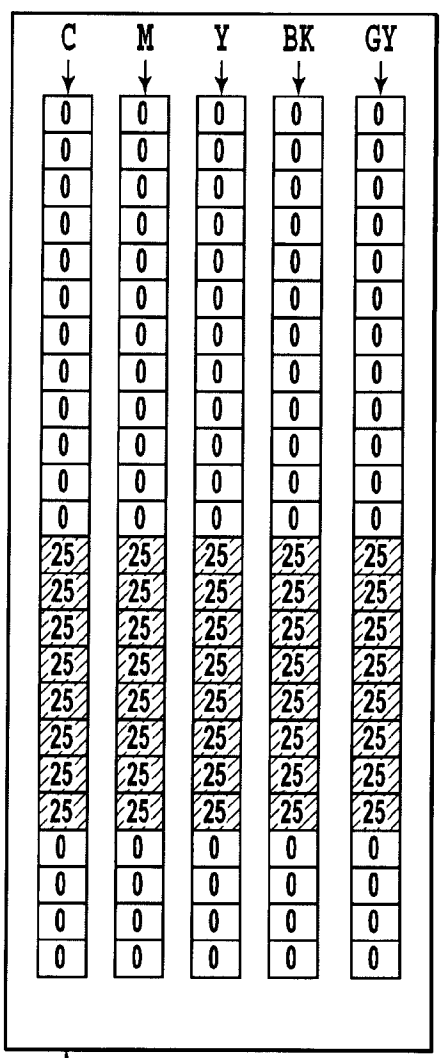
FIGS. 22A, 22B and 22C are explanatory diagrams used for explaining nozzle-use ranges applied to a central portion, transitional portions, and a front and a rear end portions in a case of a third embodiment, respectively.
Figure 22B:
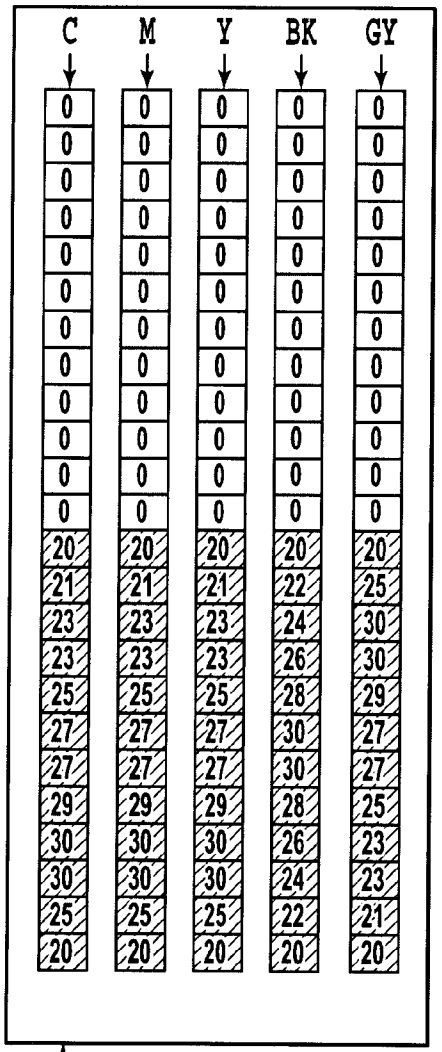
Figure 22A:
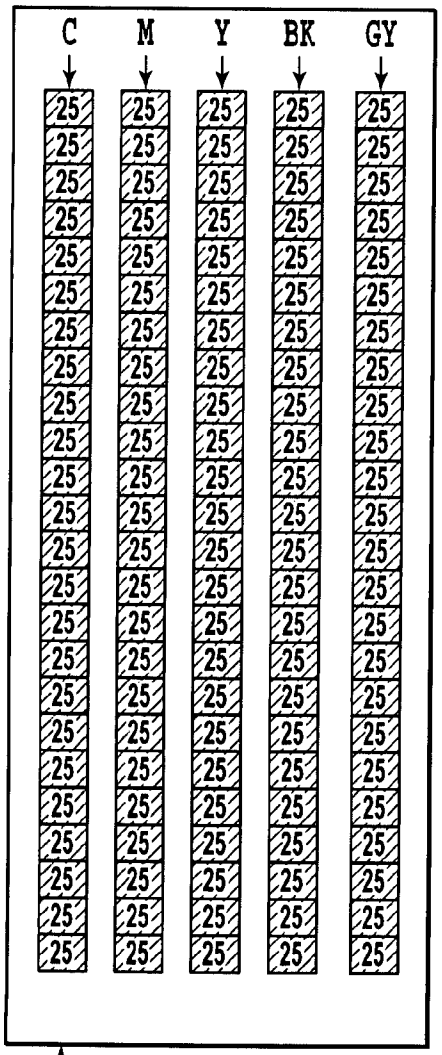

FIGS. 22A, 22B and 22C are diagrams each showing a configuration of nozzle arrays in a printing head adopted for a third embodiment of the present invention, and concurrently each used for explaining how the nozzles are used for the central portion, the transitional portions, as well as the front and rear end portions. The printing head according to the present embodiment includes a nozzle array 41C for the cyan ink, a nozzle array 41M for the magenta ink, a nozzle array 41Y for the yellow ink, a nozzle array 41Bk for the black ink, and a nozzle array 41Gy for the grey (Gy) ink. The number of nozzles in each nozzle array, a density with which the nozzles are arranged in the printing head, the grouping of the nozzles in the printing head and the number of passes (=4) for multi-pass printing are the same as those in the first embodiment. In addition, a numeric value in each block representing each group indicates a print allowing rate of the group. Hatched nozzle groups (or groups whose print allowing rate is not equal to 0 (zero)) are nozzle-use ranges.

FIGS. 22A to 22C show an example in a case of a 4-pass printing. The print allowing rate for each nozzle group is assigned such that the total of print allowing rates of four nozzle groups used in four main scans becomes 100%. For example, when a printing is performed on the central portion and when a printing is performed on the front/rear end portion, as shown in FIGS. 22A and 22B, respectively, the print allowing rate for each nozzle group is set to 25%, the printing with the print allowing rate of 25% is performed in each of the four main scans, and thereby a printing with the total of print allowing rates, i.e., 100%, is achieved by the 4-pass printing. On the other hand, in a case where a printing is performed on each of the transitional portions, as shown in FIG. 22B, the print allowing rate for each nozzle group is set to 20-30%, the printing with the print allowing rate of 20-30% is performed in each of the four main scans, and thereby a printing with the total of print allowing rates, i.e., 100%, is achieved by the 4-pass printing. More specifically, in this case, the print allowing rate of 20-30% is assigned for each nozzle group such that the total of print allowing rates of four nozzle groups every three groups that are used in the four main scans becomes 100%. For example, as to the nozzle array for cyan, magenta or yellow ink, the 4-pass printing is performed by a set of four nozzle groups with the print allowing rates of 20%, 23%, 27% and 30%, or by a set of four nozzle groups with the print allowing rates of 21%, 25%, 29% and 25%.

In the present embodiment, the size and position of the nozzle-use range for each color is designed to be equivalent each other in each of the central portion, the front and rear end portions, as well as the transitional portions. Moreover, the distribution of the print allowing rate for each color is designed to be the same each other for each of the central portion as well as the front and rear end portions (FIGS. 22A and 22C), whereas the distribution of the printing allowing rate for each color is designed to be different among the chromatic color inks, the Bk ink and the Gy ink (FIG. 22B). In other words, for the transitional portion, each of the first and second embodiments shifts the position of the nozzle-use range in the nozzle array for the achromatic color (or each of the achromatic colors) from the positions of the nozzle-use ranges in the nozzle arrays for the chromatic colors, and uniformly sets the print allowing rate at 25% throughout all of the nozzle-use ranges for the inks respectively of all of the four (or five) colors. For the transitional portion, the present embodiment makes the positions of the nozzle-use ranges in the nozzle arrays for all of the five colors correspond to one another, and sets up the three distributions of the print allowing rate respectively. In the case of the illustrated example, the print allowing rate at the end portion of each nozzle-use range is uniformly set at 20% throughout all of the five colors, and the highest print allowing rate of each nozzle-use range is uniformly set at 30% throughout all of the five colors. However, the position of a block (or a nozzle group) where the print allowing rate is at its maximum is designed to be different among the group of the chromatic color inks, the Bk ink and the Gy ink. In addition, for each of the C, M and Y colors, the block where the print allowing rate is at its maximum is designed to be closer to one end portion of its corresponding nozzle-use range. For the Bk, the block where the print allowing rate is at its maximum is designed to be in the middle of its corresponding nozzle-use range. For the Gy, the block where the print allowing rate is at its maximum is designed to be closer to the other end portion of its corresponding nozzle-use range.

Figure 23:
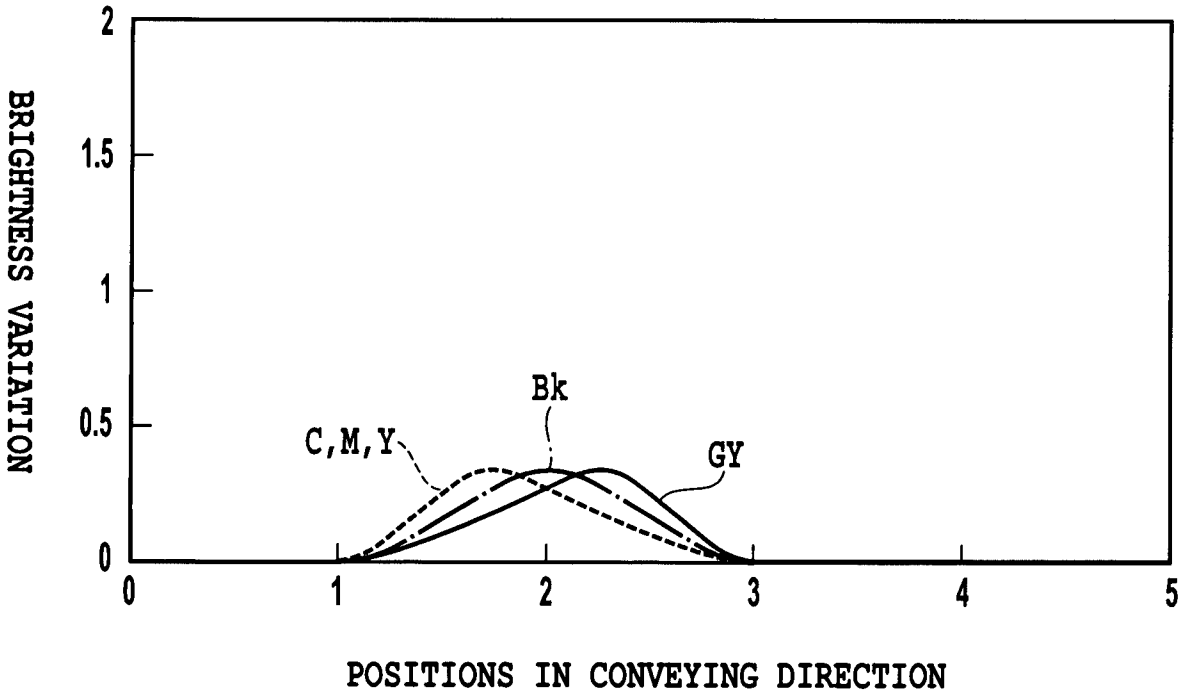
FIG. 23 is an explanatory diagram showing a relationship between positions in the direction in which the printing medium is conveyed and brightness variations stemming from a sudden conveyance error in a case where a third embodiment is applied.

FIG. 23 shows a relationship between positions in the direction in which a printing medium is conveyed and each of brightness variations which takes place respectively in an area where a printing is performed by use of the chromatic colors (C, M and Y), an area where a printing is performed by use of the Bk, and an area where a printing is performed by use of the Gy, when a sudden conveyance error occurs in the case of the inkjet printing apparatus and method to which the present embodiment is applied. In this embodiment, because the three types of nozzle-use ranges are set up for each of the transitional portions, when an index of 1 (one) is assigned to the maximum value of the overall brightness variation in each of the transitional portions, the maximum value of the brightness variation in each of the three areas is ⅓.

Figure 24:
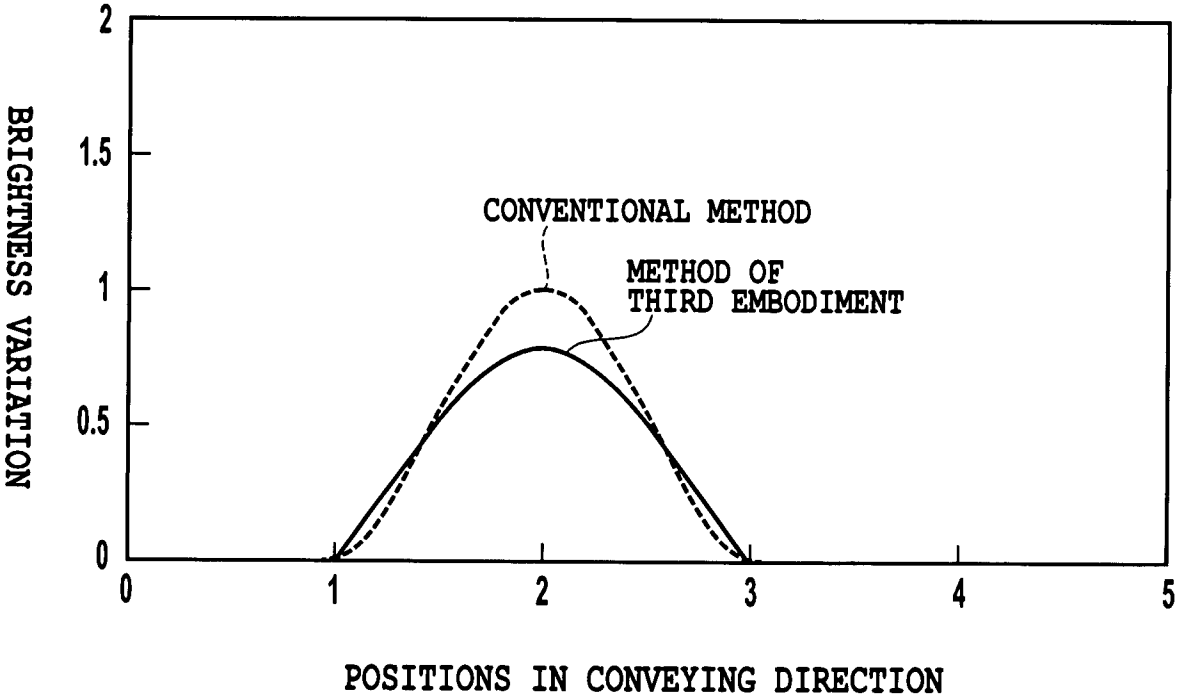
FIG. 24 is an explanatory diagram showing the relationship between positions in the direction in which the printing medium is conveyed and brightness variation in the case where the prior art is applied, and a relationship between positions in the direction in which the printing medium is conveyed and brightness variation in a case where the third embodiment is applied.

FIG. 24 shows the relationship between positions in the direction in which the printing medium is conveyed and brightness variation in the case of the inkjet printing apparatus and method to which the prior art is applied, and a relationship between positions in the direction in which the printing medium is conveyed and brightness variation in the case of the inkjet printing apparatus and method to which the present embodiment is applied. As clear from FIG. 24, it is learned that this embodiment brings about the same effects as the foregoing embodiments by making the distribution of the print allowing rate in each nozzle-use range different among the group of the chromatic color inks, the Bk ink and the Gy ink without shifting the positions of the nozzle-use ranges.

It is possible to decrease the maximum value (or Evaluation Factor 2) of the overall brightness variation by making the position where the brightness variation is at its maximum different among the five colors. However, it should be noted that, as long as the distribution of the print allowing rate in each nozzle-use range is different among the five colors, the position where the brightness variation is at its maximum may be the same throughout the five colors. This arrangement is capable of reducing the gradient (represented by Evaluation Factor 1) of the overall brightness variation, but leaves the maximum value (or Evaluation Factor 2) of the overall brightness variation almost unchanged.

In addition, this embodiment is not limited to the case that a printing is performed with the printing density equal to the pitches with which the nozzles are arranged, and is applicable to a case that a printing is performed with a printing density higher than the pitches with which the nozzles are arranged. Even in the latter, similarly the nozzles are caused to scan multiple times for each raster.

(Others)

The present invention aims at shifting the position where brightness variation takes place in an area where a printing is performed by use of an ink of a first color due to a sudden conveyance error from the position where brightness variation takes place in another area where a printing is performed by use of an ink of a second color due to the sudden conveyance error through a configuration which reduces the size of the nozzle-use range assigned for each of multiple colors. For this reason, the present invention is not limited to the first to third embodiments or the modification derived from the three embodiments. The present invention can be carried out as a combination of two or more of the three embodiments and their derivative modifications. For example, it is possible to apply both the first embodiment for shifting the position of the nozzle-use range for the ink of the first color from the position of the nozzle-use range for the ink of the second color and the third embodiment for making the distribution of the print allowing rate for the ink of the first color different from the distribution of the printing allowing rate for the ink of the second color.

Furthermore, a margin-less printing may be performed on either the front end portion of a printing medium or the rear end portion thereof. Moreover, the number of colors of used inks, the number of nozzles (or printing elements), the ratio of reduction of the sizes of the respective nozzle-use ranges, the rate of reduction of a distance at which a printing medium is conveyed in an interval between each two consecutive main scans, the number of passes for the multi-pass printing operations, and the like have been described as the numerical examples for the illustration purpose. It is the matter of course that appropriate numerical values can be adopted for these items depending on the necessity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-129356, filed May 15, 2007, which is hereby incorporated by reference herein in its entirety.

What is claimed is:

1. An inkjet printing apparatus for performing printing on a printing medium by using a printing head including a first nozzle array formed by arranging nozzles, for ejecting ink of a first color, in a predetermined direction and a second nozzle array formed by arranging nozzles, for ejecting ink of a second color different from the first color, in the predetermined direction, the apparatus comprising:

a scanning unit that performs scans of the printing head with respect to the printing medium in a scan direction crossing the predetermined direction;

a conveying unit that conveys the printing medium in a convey direction crossing the scan direction; and a print controller constructed to selectively execute, depending on a conveying position of the printing medium, a scan for performing a printing in a first printing control process, a scan for performing a printing in a second printing control process, and a scan for performing a printing in a third printing control process, wherein in the first printing control process, nozzles to be used are provided in a predetermined range of the first nozzle array and in a predetermined range of the second nozzle array, wherein in the second printing control process, nozzles to be used are provided in a first range of the first nozzle array and in a second range of the second nozzle array, a position of the first range in the first nozzle array and a position of the second range in the second nozzle array being substantially equal in the convey direction, the first range being smaller than the predetermined range of the first nozzle array, the second range being smaller than the predetermined range of the second nozzle array, and wherein in the third printing control process, nozzles to be used are provided in a third range of the first nozzle array and in a fourth range of the second nozzle array, a position of the third range of the first nozzle array and a position of the fourth range of the second nozzle array being shifted from each other in the convey direction, the third range being smaller than the predetermined range of the first nozzle array, the fourth range being smaller than the predetermined range of the second nozzle array.

2. An inkjet printing apparatus as claimed in claim 1, wherein the print controller brings to completion of an image to be printed to a unit area on the printing medium with a plurality of the scans.

3. An inkjet printing apparatus as claimed in claim 1, wherein the conveying unit has a first conveying unit positioned upstream in the conveying direction and a second conveying unit positioned downstream in the conveyance direction, and wherein the print controller executes the scan for performing the printing in the third printing control process, in a case where the printing is performed on:

a transitional portion where the printing is in the process of transition from the printing being made on a front end portion of the printing medium while only the first conveying unit holds the printing medium, to the printing being made on the printing medium while both the first and the second conveying units hold the printing medium; and another transitional portion where the printing is in the process of transition from the printing being made on the printing medium while both the first and the second conveying units hold the printing medium, to the printing being made on a rear end portion of the printing medium while only the second conveying unit holds the printing medium.

4. An inkjet printing apparatus as claimed in claim 1, wherein the first color is an achromatic color, and the second color is a chromatic color.

5. An inkjet printing method of printing on a printing medium by using a printing head including a first nozzle array formed by arranging nozzles, for ejecting ink of a first color, in a predetermined direction and a second nozzle array formed by arranging nozzles, for ejecting ink of a second color different from the first color, in the predetermined direction, the method comprising the steps of:

printing by using the printing head in a scan of the printing head with respect to the printing medium in a scan direction crossing the predetermined direction;

conveying the printing medium in a convey direction crossing the scan direction; and selectively executing, depending on a conveying position of the printing medium, a scan for performing a printing in a first printing control process, a scan for performing printing in a second printing control process, and a scan for performing a printing in a third printing control process, wherein the first printing control process, nozzles to be used are provided in a predetermined range of the first nozzle array and in a predetermined range of the second nozzle array, wherein in the second printing control process, nozzles to be used are provided in a first range of the first nozzle array and in a second range of the second nozzle array, a position of the first range in the first nozzle array and a position of the second range in the second nozzle array being substantially equal in the convey direction, the first range being smaller than the predetermined range of the first nozzle array, the second range being smaller than the predetermined range of the second nozzle array, and wherein in the third printing control process, nozzles to be used are provided in a third range of the first nozzle array and in a fourth range of the second nozzle array, a position of the third range of the first nozzle array and a position of the fourth range of the second nozzle array being shifted from each other in the convey direction, the third range being smaller than the predetermined range of the first nozzle array, the fourth range being smaller than the predetermined range of the second nozzle array.

6. The inkjet printing apparatus according to claim 1, wherein the position of the third range which is a part of the first nozzle array and the position of the fourth range which is a part of the second nozzle array are provided such that a gradient of overall brightness variation for the first and second colors is decreased.

7. The inkjet printing method according to claim 5, wherein the position of the third range which is a part of the first nozzle array and the position of the fourth range which is a part of the second nozzle array are provided such that a gradient of overall brightness variation for the first and second colors is decreased.

8. An inkjet printing method as claimed in claim 5, wherein the printing medium is conveyed by a first conveying unit positioned upstream in the conveying direction and a second conveying unit positioned downstream in the conveyance direction, and wherein the scan for performing the printing in the third printing control process is executed in a case where the printing is performed on:

a transitional portion where the printing is in the process of transition from the printing being made on a front end portion of the printing medium while only the first conveying unit holds the printing medium, to the printing being made on the printing medium while both the first and the second conveying units hold the printing medium; and another transitional portion where the printing is in the process of transition from the printing being made on the printing medium while both the first and the second conveying units hold the printing medium, to the printing being made on a rear end portion of the printing medium while only the second conveying unit holds the printing medium.

9. An inkjet printing method as claimed in claim 5, wherein the first color is an achromatic color, and the second color is a chromatic color.

* * * * *